US006804857B1

(12) United States Patent
Olewiler, III

(10) Patent No.: US 6,804,857 B1
(45) Date of Patent: Oct. 19, 2004

(54) APPARATUS FOR DAMPENING THE NOISE OF A VACUUM CLEANER

(75) Inventor: Grant M. Olewiler, III, Bakersfield, CA (US)

(73) Assignee: M.D. Manufacturing, Inc., Bakersfield, CA (US)

( * ) Notice: Subject to any disclaimer, the term of this patent is extended or adjusted under 35 U.S.C. 154(b) by 306 days.

(21) Appl. No.: 09/957,824

(22) Filed: Sep. 20, 2001

(51) Int. Cl.[7] ..... A47L 5/00; A47L 9/00
(52) U.S. Cl. ..... 15/326; 15/327.6
(58) Field of Search ..... 15/314, 326, 327.6

(56) References Cited

U.S. PATENT DOCUMENTS

| | | | | |
|---|---|---|---|---|
| 2,475,815 A | | 7/1949 | Burd | |
| 2,778,441 A | * | 1/1957 | Herriott | 55/357 |
| 3,101,889 A | * | 8/1963 | Tatge | 417/363 |
| 4,617,034 A | | 10/1986 | Ikezaki et al. | |
| 4,938,309 A | | 7/1990 | Emdy | |
| 4,970,753 A | | 11/1990 | Herron | |
| 5,400,463 A | | 3/1995 | Attard et al. | |
| 5,502,869 A | | 4/1996 | Smith et al. | |
| 5,513,417 A | | 5/1996 | Kim et al. | |
| 5,560,075 A | * | 10/1996 | Jankowski | 15/327.6 |
| 5,737,798 A | | 4/1998 | Moren et al. | |
| 6,158,080 A | * | 12/2000 | Schlapkohl | 15/301 |
| 6,192,551 B1 | * | 2/2001 | Roth | 15/413 |
| 6,237,186 B1 | * | 5/2001 | Griffiths | 15/319 |
| 6,330,732 B1 | * | 12/2001 | Liu | 15/314 |

* cited by examiner

*Primary Examiner*—Terrence R. Till
(74) *Attorney, Agent, or Firm*—Thomas I. Rozsa; Tony D. Chen

(57) ABSTRACT

An improved vacuum cleaner has an acoustic dampening mechanism to substantially reduce the noise level generated from a suction unit of the vacuum cleaner while it is sufficiently cooled. Noise that radiates from the motor is continually sucked back into the motor and in effect, the noise is bent by using suction so that the noise is muffled by being pulled back into the motor.

15 Claims, 26 Drawing Sheets

APPARATUS FOR DAMPENING THE NOISE OF A VACUUM CLEANER

BACKGROUND OF THE INVENTION

1. Field of the Invention

The present invention relates generally to the field of vacuum cleaning systems in which a central motor, suction, waste catching unit and disposal unit serve as the central power and suction source. More particularly, the present invention relates to the field of improved vacuum cleaner acoustic dampening systems which serve to substantially reduce the noise level generated by the suction source.

2. Description of the Prior Art

In general, vacuum cleaners are well known in the art. One example of prior art vacuum cleaning systems is a built-in central vacuum cleaning system manufactured by M. D. Manufacturing Co. The system comprises a central motor, suction, waste catching unit and disposal unit which serves as the central power and suction source. The system is attached through a suction hose into a central suction gathering duct which in turn extends through a network of suction ducts, a respective one of which terminates in a vacuum inlet in the various rooms of a home. When not in use, the vacuum inlet is covered by a plate. In use, the vacuum inlet is opened and the vacuum hose is plugged into the inlet. The central power and suction source is activated and the suction force draws in dirt and dust through the vacuum cleaner nozzle attached at the end of the vacuum hose.

One major disadvantage of any vacuum cleaner known in the art is the creation of a very substantial amount of noise by the suction source. In most conventional vacuum cleaners known in the art, the noise level generated from the suction source lies in the range of 85 to 96 decibels. It is almost impossible to comfortably work in such locations when the vacuum cleaner is running, as the high noise level is sometimes deafening and at best extremely irritating.

The following eight (8) prior art patents are found to be pertinent to the field of the present invention:

1. U.S. Pat. No. 2,475,815 issued to Burd on Jul. 12, 1949 for "Vacuum Cleaning Device" (hereafter the "Burd");
2. U.S. Pat. No. 4,617,034 issued to Ikezaki et al. on Oct. 14, 1986 for "Electric Cleaner With Minimum Noise" (hereafter the "Ikezaki");
3. U.S. Pat. No. 4,938,309 issued to Emdy on Jul. 3, 1990 for "Built-In Vacuum Cleaning System With Improved Acoustic Damping Design" (hereafter the "Emdy");
4. U.S. Pat. No. 4,970,753 issued to Herron on Nov. 20, 1990 for "Vacuum Cleaner Noise Reducing Arrangement" (hereafter the "Herron");
5. U.S. Pat. No. 5,400,463 issued to Attard et al. on Mar. 28, 1995 for "Noise Damped Canister Vacuum Cleaner" (hereafter the "Attard");
6. U.S. Pat. No. 5,502,869 issued to Smith et al. on Apr. 2, 1996 for "High Volume, High Performance, Ultra Quiet Vacuum Cleaner" (hereafter the "Smith");
7. U.S. Pat. No. 5,513,417 issued to Kim et al. on May 7, 1996 for "Silencing Device For Vacuum Cleaner" (hereafter the "Kim"); and
8. U.S. Pat. No. 5,737,798 issued to Morén et al. on Apr. 14, 1998 for "Device For A Vacuum Cleaner And A Method For Cooling A Motor" (hereafter the "Morén").

Burd discloses a vacuum cleaning device. It comprises a conical sheet metal into which the dust and debris is located and a motor with multiple fan blades located at the bottom of the device. The airflow goes directly from the conical receptacle to the multiple fan blades of the motor and does not serve to circulate around the motor to cool it.

Ikezaki discloses an electric cleaner with minimum noise. It comprises a noise suppression arrangement for minimizing the noise generated by the exhaust from the electric air blower.

Emdy discloses a built-in vacuum cleaning system with an improved acoustic damping design. The canister of the central power and suction unit rests on the floor. The motors of the central power and suction unit are enclosed within an interior chamber which includes at its lower end a baffle supporting an acoustic damper and the interior chamber is vented through exhaust ports, where the tips of the armatures are separated from the remainder of the armatures and motors by the baffle and the tips of the armatures extend into another chamber which further includes a second acoustic damper within the chamber and further includes openings for permitting cooling air to enter the chamber.

Herron discloses a vacuum cleaner noise reducing arrangement. It comprises a noise reduction compartment formed in its housing through which the exhaust air flow is caused to travel and a two part cartridge which is internally formed with interleaved sets of baffle plates and is installed within the noise reduction compartment. The cartridge is arranged so that the exhaust air flow passes therethrough and is internally configured to interfere with the free flow of the exhaust.

Attard discloses a noise dampened canister vacuum cleaner. It comprises a baffle which reduces the noise generated by the vacuum cleaner. The baffle is interposed between pump outlets and air outlets of the canister in a manner which provides little resistance to a flow of air from the pump outlets to the air outlets of the canister.

Smith discloses an ultra quiet vacuum cleaner having a bag cavity, a motor/blower chamber connected to the cavity by a flexible coupling and an active, adaptive noise cancellation controller so configured to quiet the exhaust of the air used to cool the motor/blower unit. Fast compensation and feedback compensation allow use of a straight short duct for superior cancellation performance.

Kim discloses a silencing device for a vacuum cleaner. It comprises dampers for absorbing operational vibrations of a suction motor. The operational noises of the suction motor are intercepted and suppressed by a middle case, a lower case, a bottom case and a top case. The exhaust noises caused by exhaust air flow are repeatedly absorbed and suppressed by a plurality of exhaust ports. The exhaust air flow is also dispersed so as to suppress the exhaust noises.

Morén discloses a device for a vacuum cleaner and a method for cooling a motor. The motor of the vacuum cleaner is cooled by an air stream independent of a primary dirt laden air stream. The vacuum cleaner includes a turbofan unit including an impeller driven by an electric motor which is located after a dust bag, seen in the direction of air flow. The impeller is driven at a speed in excess of 50,000 RPM by the electric motor and produces a primary stream of air which flows around the motor and cools the motor.

It is highly desirable to have a very efficient and also very effective design and construction of an improved vacuum cleaner with improved exhaust means and substantially improved acoustic dampening means to significantly lower the noise level generated by the suction source.

SUMMARY OF THE INVENTION

The present invention is an improved vacuum cleaner with improved exhaust means and improved acoustic dampening means. The present invention relates to an improved design for the suction mechanism of any vacuum cleaner, which improved design provides significant acoustic dampening to substantially reduce the noise level generated from the suction mechanism while it is sufficiently cooled. Noise that radiates from the motor is continually sucked back into the motor. In effect, the noise is bent by using suction so that the noise is muffled by being pulled back into the motor.

It has been discovered, according to the present invention, that if one or more motors is housed in a lower portion of a canister of a vacuum cleaner and thereby operates inside of a vacuum cleaner's negative pressured plenum chamber, then the noise level generated from the motors is very substantially reduced.

It has additionally been disclosed, according to the present invention, that if the air is sucked into a vacuum cleaner's negative pressured plenum chamber of a vacuum cleaner and gets sucked into the cooling impellers and then into the center impellers of the motors and is moved out from the exhaust pipe, then the noise level generated from the motors is reduced while also cooling the motors.

It has further been discovered, according to the present invention, that by providing a deflector or baffle which is located around the motors which therefore causes air to go into the cooling impellers and the sucked air is forced to go into the motors, then the noise level generated from the motors is very substantially reduced while the motors are sufficiently cooled.

It is therefore an object of the present invention to provide improvements in the suction mechanism of any vacuum cleaner which will very substantially reduce the noise from the suction mechanism.

It is a further object of the present invention to provide a dampening means which will accommodate conventional power unit canister designs and further accommodate conventional configurations for the placement of the motors and armatures.

It is an additional object of the present invention to provide substantially enhanced noise dampening means to the suction mechanism while at the same time providing sufficient venting to assure that the armatures of the motors will be cooled by incoming cooling air and the hot air from the motors can be efficiently exhausted.

It is a further object of the present invention to provide one or more motors which is housed in a lower portion of a canister of a vacuum cleaner and operate it inside of a vacuum cleaner's negative pressured plenum chamber, so that the noise level generated from the motors is very substantially reduced.

It is a further object of the present invention to provide suction such that the air is sucked into a vacuum cleaner's negative pressured plenum chamber of a vacuum cleaner and gets sucked into the cooling impellers and into to the center impellers of the motors and is caused to be moved out from the exhaust pipe, so that the noise level generated from the motors is reduced while also cooling the motors.

It is a further object of the present invention to provide a deflector or baffle which is located around the motors which therefore causes air to go into the cooling impellers and the sucked air is forced to go into the motors, so that the noise level generated from the motors is very substantially reduced while the motors are sufficiently cooled.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

In summary, the present invention is an improved design for central vacuum cleaning systems and portable vacuum cleaners which improved design provides significant acoustic dampening to substantially reduce the noise level generated from a suction unit while at the same time one or more motors is being sufficiently cooled within the vacuum cleaner.

Figure 1:
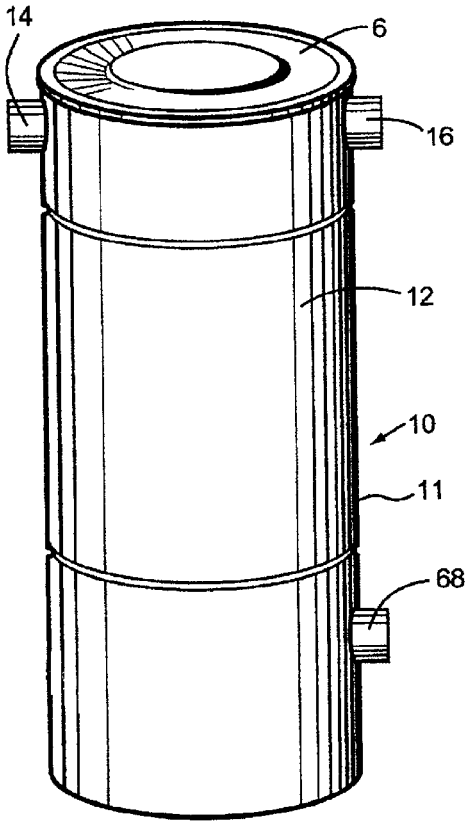
FIG. 1 is a front elevational view of a central vacuum cleaning system in accordance with the present invention.
Figure 2:
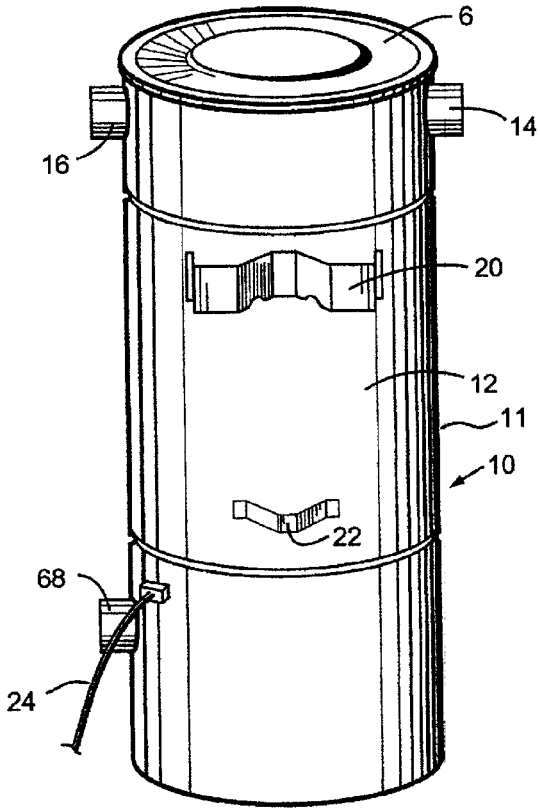
FIG. 2 is a rear elevational view of the central vacuum cleaning system shown in FIG. 1.
Figure 3:
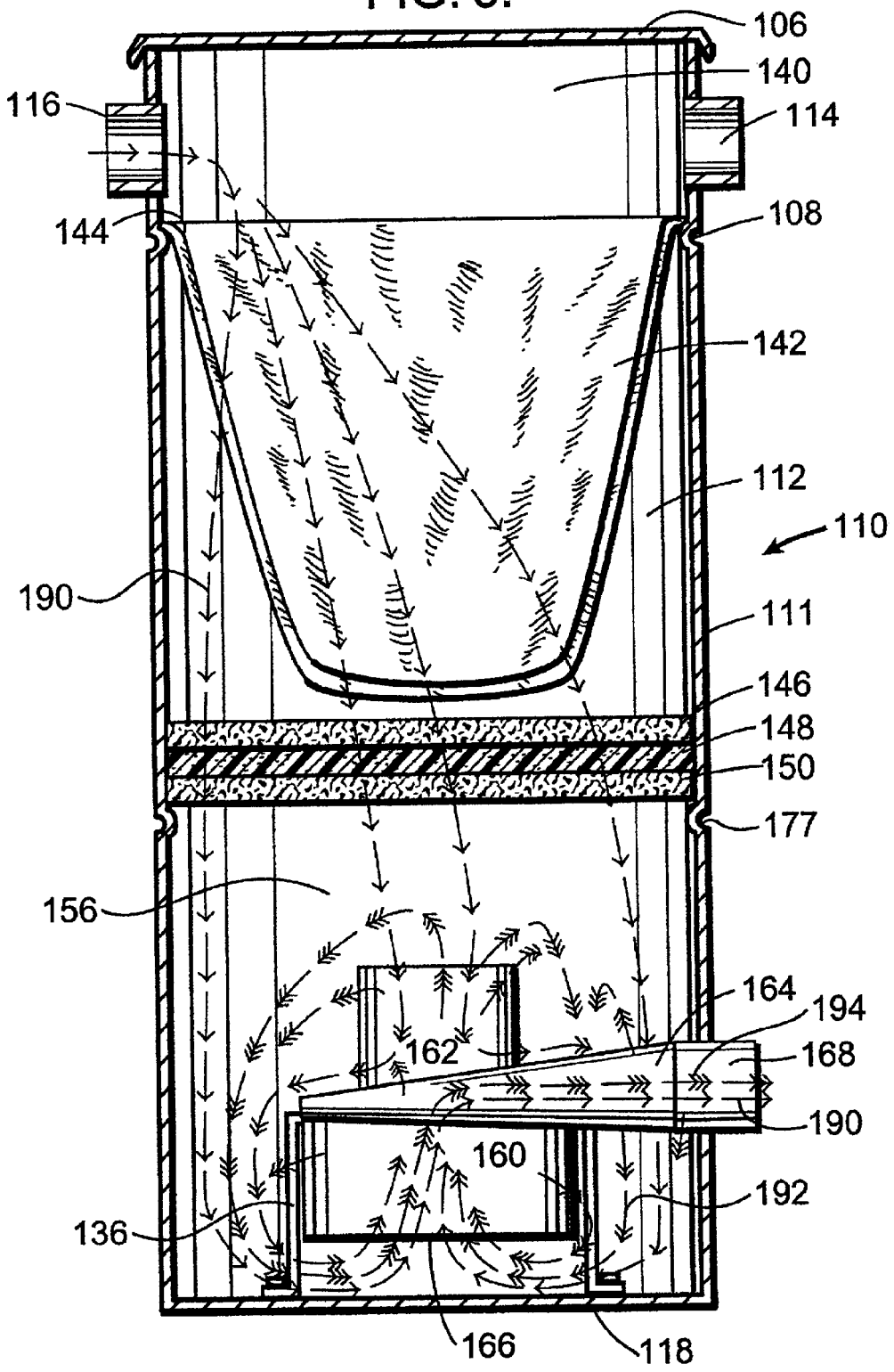
FIG. 3 is an enlarged longitudinal cross-sectional view looking from the front of the preferred embodiment of the central vacuum cleaning system, illustrating a first arrangement of the improvements of the present invention therein.

Referring to FIGS. 1 and 2, there is shown at 10 a preferred embodiment of the present invention central vacuum cleaning system. The exterior structure of the present invention central vacuum cleaning system 10 is conventional in the art and comprises an erect cylindrical canister 11 which houses a central power and suction unit. The canister 11 comprises a circumferential sidewall 12 which has a pair of air intake ports 14 and 16 located adjacent a top lid 6 of the canister. An on-off switch (not shown) is provided with the system 10 for turning the system on or off and located on the canister 11. An exhaust port 68 is provided and located adjacent to the bottom of the canister 11. An upper bracket 20 and a lower bracket 22 are vertically aligned along the rear surface of the sidewall 12 and provide an optional attachment means by which the canister 11 can be mounted on a wall. A power cord 24 connects the central power and suction unit to an electrical power source. The top lid 6 of the canister is removable to expose a dust collection chamber and receptacle, as illustrated in FIG. 3. All of the components described above are conventional in the art, and the description thereof will not be repeated in the various arrangements of the improvements of the present invention shown in FIGS. 3 through 17.

Referring to FIG. 3, there is shown a first arrangement of the improvements of the present invention central vacuum cleaning system 110. The canister 111 comprises an upper interior hollow compartment 140 and a lower interior hollow compartment 156. Either compartment may or may not have acoustical material lining on the walls. The upper compartment 140 houses within it a removable dirt and dust collection bag 142. The collection bag 142 has an upper rim 144 which rests on an interior ledge 108 of the interior wall of the canister 111. Below the dirt and dust collection bag 142 are a plurality of filters, which include a first mesh or coarse filter 146, a fine or foam filter 148 and a second mesh or coarse filter 150. The first filter 146 rests on top of the foam filter 148 which in turn rests on top of the second filter 150, which in turn all rest on a second interior ledge 177.

As can be seen by the airflow arrows 190 (with only one arrow head), suction created by an electrical motor 160 causes a flow of suction air into the upper interior chamber 140 of the canister 111 and creates a suction which draws dirt, dust and other particulates into the collection bag 142. Since the bag 142 is porous to allow air flow through it, the filters 146, 148 and 150 serve to trap any escaped dirt and dust so that it will not damage the motor 160. The portion described so far are conventional components which are known in prior art central power and suction unit designs.

The present invention central vacuum cleaning system 110 can operate with any plurality of motors within its design. At least one motor 160 and armature 162 is required for the central power and suction unit. Conventionally, either one, two or three motors can be used. In this first arrangement of the improvements of the present invention central vacuum cleaning system 110 as illustrated in FIG. 3, only one motor 160 is used. The motor 160 is housed in the second interior compartment 156 as shown which lies below the upper interior hollow compartment 140 and is separated from it by the filters. The motor 160 is mounted above and spaced apart from a lower base 118 of the canister 111 by a bracket 136. The motor 160 by way of example can be 120 volts, one and one-quarter (1¼) horsepower suction motor. There is provided a motor exhaust horn 164 which extends into the second interior chamber 156 and extends out from the canister sidewall 112 and connects to the exhaust port 168. As can be seen by the flow arrows 190 and 194, the exhaust port 168 is important to provide an exit for the air flow from the motor armature 162 to escape from the canister 111. As represented by the arrows, the suction air 190 is represented by an arrow having one arrow head, cooling air 192 is represented by an arrow having two arrow heads, and noise flow 194 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 160 is housed. The electrical motor operates inside of a vacuum cleaner's negative pressured plenum chamber 156 within the vacuum created by the vacuum cleaner, and thereby it will greatly reduce the noise level emitted by the motor. All prior art locates the loud suction motor outside of the negative pressured plenum chamber.

The airflow patterns 190, 192 and 194 are disclosed. Specifically, the suction air flow 190 is sucked into the canister 111 from the intake ports 116 and 114 and as is shown, goes through the filters 146, 148, and 150 and into the center impeller 162 which helps cool the motor as well. The suction air 190 becomes cooling air 192 which goes around the motor and into the motor opening 166 for cooling the motor and substantially reducing the noise level of the motor 160. The noise flow 194 is moved out of the canister 111 by the exhaust horn 164 which is connected to the exhaust port 168. Noise that radiates from the motor is continually sucked back into the motor. In effect, the noise is bent by using suction so that the noise is muffled by being pulled back into the motor.

Figure 4:
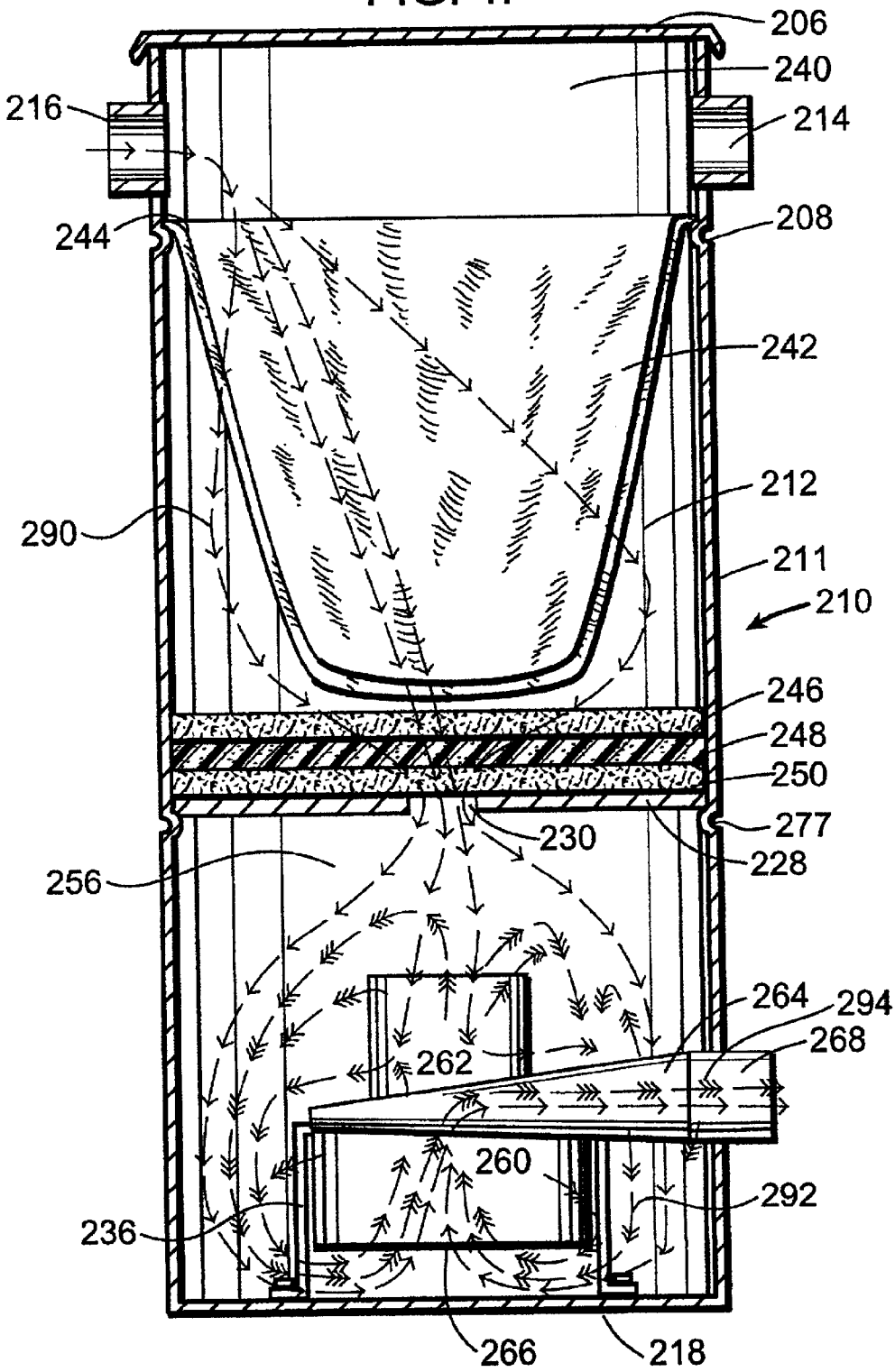
FIG. 4 is an enlarged longitudinal cross-sectional view looking from the front of the central vacuum cleaning system, illustrating a second arrangement of the improvements of the present invention therein.

Referring to FIG. 4, there is shown a second arrangement of the improvements of the present invention central vacuum cleaning system 210. This second arrangement of the improvements of the present invention is very similar to the first arrangement just discussed above and the only difference is the nature and configuration of an air diffuser plate 228 which separates the two compartments of the cleaning system 210. All of the parts of the second arrangement are correspondingly numbered in a 200 series reference number rather than a 100 series reference number used in the first arrangement. The canister 211 comprises an upper interior hollow compartment 240, a lower interior hollow compartment 256, and an air diffuser plate 228 which separates the upper and lower compartments 240 and 256. The upper compartment 240 houses within it a removable dirt and dust collection bag 242. The collection bag 242 has an upper rim 244 which rests on an interior ledge 208 of the interior wall of the canister 211. Below the dirt and dust collection bag 242 are a plurality of filters, which include a first mesh or coarse filter 246, a fine or foam filter 248 and a second mesh or coarse filter 250. The first filter 246 rests on top of the foam filter 248 which in turn rests on top of the second filter 250, which in turn all rest on top of the barrier 228 which in turn rests on top of a second interior ledge 277.

As can be seen by the suction air flow arrows 290 (with only one arrow head), suction created by an electrical motor 260 causes a flow of air into the upper interior chamber 240 of the canister 211 and creates a suction which draws dirt, dust and other particulates into the collection bag 242. Since the bag 242 is porous to allow air flow through it, the filters 246, 248 and 250 serve to trap any escaped dirt and dust so that it will not damage the motor 260. The portion described so far are conventional components which are known in prior art central power and suction unit designs.

The present invention central vacuum cleaning system 210 can operate with any plurality of motors within its design. At least one motor 260 and armature 262 is required for the central power and suction unit. Conventionally, either one, two or three motors can be used. In this second arrangement of the improvements of the present invention central vacuum cleaning system 210 as illustrated, only one motor 260 is used. The motor 260 is housed in the second interior compartment 256 as shown which lies below the upper interior hollow compartment 240 and is separated from it by the air diffuser plate 228. The motor 260 is mounted above and spaced apart from a lower base 218 of the canister 211 by a bracket 236. The motor 260 by way of example can be 120 volts, one and one-quarter (1¼) horsepower suction motor. There is provided a motor exhaust horn 264 which extends into the second interior compartment 256 and extends out from the canister sidewall 212 and connects to the exhaust port 268. As can be seen by the flow arrows 290 and 294, the exhaust port 268 is important to provide an exit for the noise flow from the motor armature 262 to escape from the canister 211. As represented by the arrows, the suction air 290 is represented by an arrow having one arrow head, cooling air 292 is represented by an arrow having two arrow heads, and noise flow 294 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 260 is housed. The electrical motor operates inside of a vacuum cleaner's negative pressured plenum chamber 256 within the vacuum created by the vacuum cleaner, and thereby, it will greatly reduce the noise level emitted by the motor.

The airflow patterns 290, 292 and 294 are disclosed. Specifically, the suction air flow 290 is sucked into the canister 211 from the intake ports 216 and 214 and as is shown, goes through the filters 246, 248, and 250 and into a central opening 230 on the air diffuser plate 228 and into the center impeller 262 which helps cool the motor as well. The suction air 290 becomes cooling air 292 which goes around the motor and into the motor opening 266 for cooling the motor and substantially reducing the noise level of the motor 260. The noise flow 294 is moved out of the canister 211 by the exhaust horn 264 which is connected to the exhaust port 268.

Figure 5:
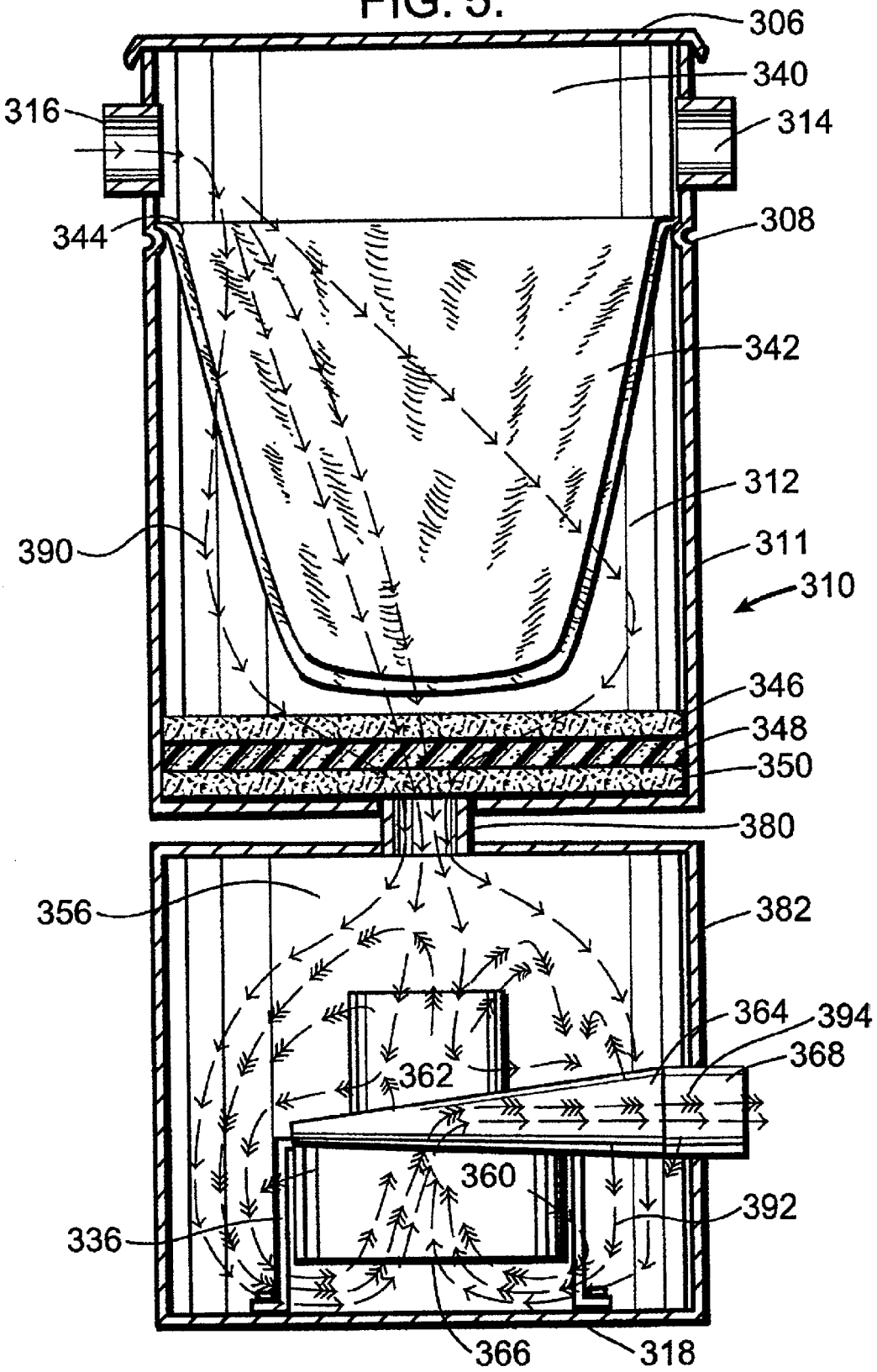
FIG. 5 is an enlarged longitudinal cross-sectional view looking from the front of the central vacuum cleaning system, illustrating a third arrangement of the improvements of the present invention therein.

Referring to FIG. 5, there is shown a third arrangement of the improvements of the present invention central vacuum cleaning system 310. This third arrangement of the improvements of the present invention is very similar to the first arrangement discussed above. All of the parts of the third arrangement are numbered correspondingly numbered in a 300 series reference number rather than a 100 series reference number used in the first arrangement. The canister 311 comprises a separate upper interior hollow compartment 340, a separate lower interior hollow compartment 356 and a neck joint 380 which connects the upper and lower compartments together. The upper compartment 340 houses within it a removable dirt and dust collection bag 342. The collection bag 342 has an upper rim 344 which rests on an interior ledge 308 of the interior wall of the canister 311. Below the dirt and dust collection bag 342 are a plurality of filters, which include a first mesh or coarse filter 346, a fine or foam filter 348 and a second mesh or coarse filter 350. The first filter 346 rests on top of the foam filter 348 which in turn rests on top of the second filter 350, which in turn all rest on the bottom of the upper interior compartment 340.

As can be seen by the suction air flow arrows 390 (with only one arrow head), suction created by an electrical motor 360 causes a flow of air into the upper interior compartment 340 of the canister 311 and creates a suction which draws dirt, dust and other particulates into the collection bag 342. Since the bag 342 is porous to allow air flow through it, the filters 346, 348 and 350 serve to trap any escaped dirt and dust so that it will not damage the motor 360. The portion described so far are conventional components which are known in prior art central power and suction unit designs.

The present invention central vacuum cleaning system 310 can operate with any plurality of motors within its design. At least one motor 360 and armature 362 is required for the central power and suction unit. Conventionally, either one, two or three motors can be used. In this third arrangement of the improvements of the present invention central vacuum cleaning system 310 as illustrated, only one motor 360 is used. The motor 360 is housed in the second interior compartment 356 as shown which lies below the upper interior hollow compartment 340. The motor 360 is mounted above and spaced apart from a lower base 318 of the lower interior compartment 356 by a bracket 336. The motor 360 by way of example can be 120 volts, one and one-quarter (1¼) horsepower suction motor. There is provided a motor exhaust horn 364 which extends into the second interior compartment 356 and extends out from the lower canister sidewall 382 and connects to the exhaust port 368. As can be seen by the flow arrows 390 and 394, the exhaust port 368 is important to provide an exit for the noise flow from the motor armature 362 to escape from the second interior compartment 356. As represented by the arrows, the suction air 390 is represented by an arrow having one arrow head, cooling air 392 is represented by an arrow having two arrow heads, and noise flow 394 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 360 is housed. The electrical motor operates inside of a vacuum cleaner's negative pressured plenum chamber 356 within the vacuum created by the vacuum cleaner, and thereby, it will greatly reduce the noise level emitted by the motor.

The airflow patterns 390, 392 and 394 are disclosed. Specifically, the suction air flow 390 is sucked into the canister 311 from the intake ports 316 and 314 and as is shown, goes through the filters 346, 348, and 350 and into the neck joint 380 and into the center impeller 362 which helps cool the motor as well. The suction air 390 becomes cooling air 392 which goes around the motor and into the motor opening 366 for cooling the motor and substantially reducing the noise level of the motor 360. The noise flow 394 is moved out of the second interior compartment 356 by the exhaust horn 364 which is connected to the exhaust port 368.

Figure 6:
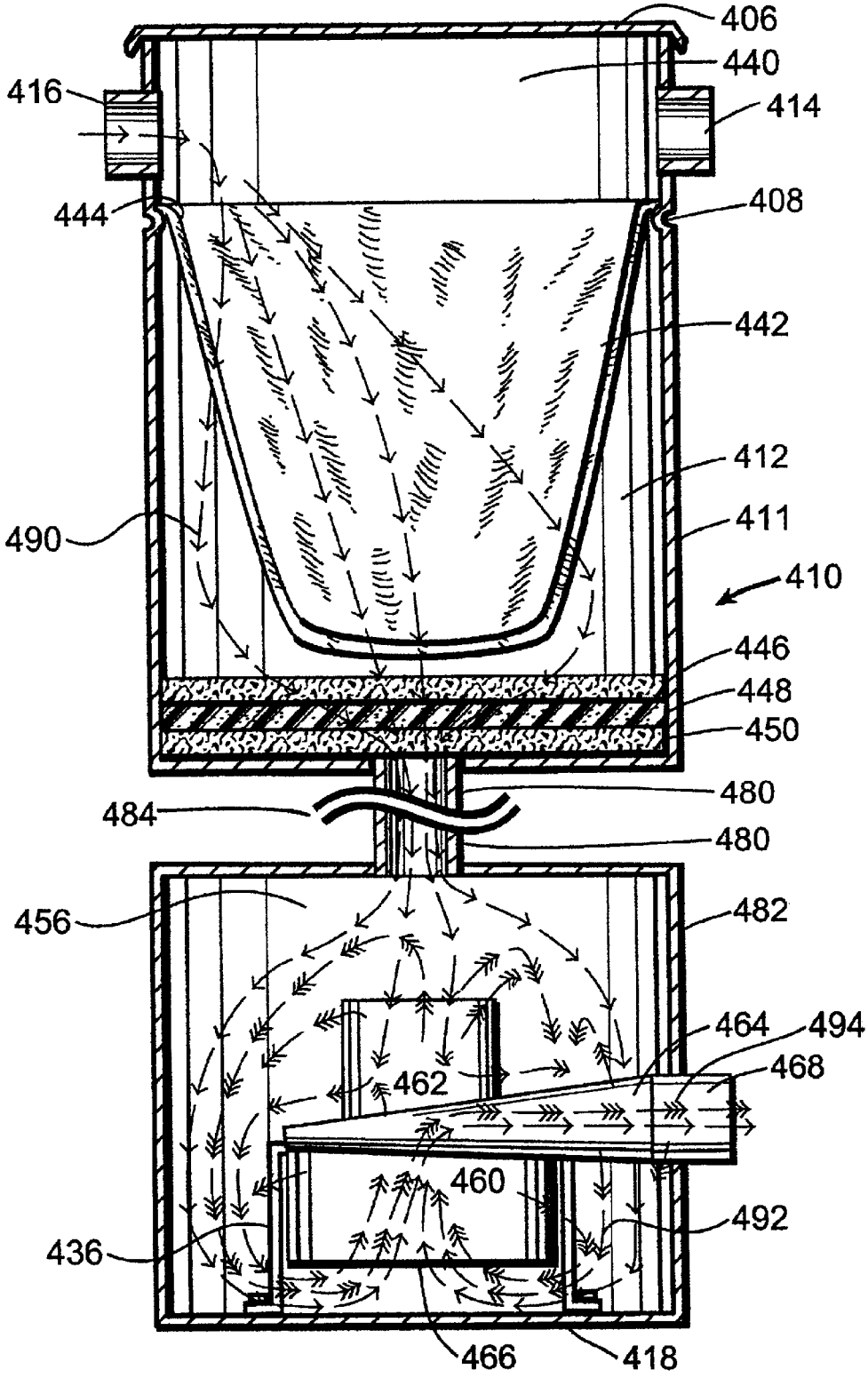
FIG. 6 is an enlarged longitudinal cross-sectional view looking from the front of the central vacuum cleaning system, illustrating a fourth arrangement of the improvements of the present invention therein.

Referring to FIG. 6, there is shown a fourth arrangement of the improvements of the present invention central vacuum cleaning system 410. This fourth arrangement of the improvements of the present invention is very similar to the third arrangement just discussed above. All of the parts of the fourth arrangement are numbered correspondingly in a 400 series reference number rather than a 100 series reference number used in the first arrangement. The canister 411 comprises a separate upper interior hollow compartment 440, a separate lower interior hollow compartment 456 and an elongated pipe 484. The elongated pipe 484 has two opposite neck joints 480 which connect the upper and lower compartments 440 and 456 together. The upper compartment 440 houses within it a removable dirt and dust collection bag 442. The collection bag 442 has an upper rim 444 which rests on an interior ledge 408 of the interior wall of the canister 411. Below the dirt and dust collection bag 442 are a plurality of filters, which include a first mesh or coarse filter 446, a fine or foam filter 448 and a second mesh or coarse filter 450. The first filter 446 rests on top of the foam filter 448 which in turn rests on top of the second filter 450, which in turn all rest on the bottom of the upper interior compartment 440.

As can be seen by the suction air flow arrows 490 (with only one arrow head), suction created by an electrical motor 460 causes a flow of air into the upper interior compartment 440 of the canister 411 and creates a suction which draws dirt, dust and other particulates into the collection bag 442. Since the bag 442 is porous to allow air flow through it, the filters 446, 448 and 450 serve to trap any escaped dirt and dust so that it will not damage the motor 460. The portion described so far are conventional components which are known in prior art central power and suction unit designs.

The present invention central vacuum cleaning system 410 can operate with any plurality of motors within its design. At least one motor 460 and armature 462 is required for the central power and suction unit. Conventionally, either one, two or three motors can be used. In this fourth arrangement of the improvements of the present invention central vacuum cleaning system 410 as illustrated, only one motor 460 is used. The motor 460 is housed in the second interior compartment 456 as shown which lies below the upper interior hollow compartment 440. The motor 460 is mounted above and spaced apart from a lower base 418 of the lower interior compartment 456 by a bracket 436. The motor 460 by way of example can be 120 volts, one and one-quarter (1¼) horsepower suction motor. There is provided a motor exhaust horn 464 which extends into the second interior compartment 456 and extends out from the lower canister sidewall 482 and connects to the exhaust port 468. As can be seen by the flow arrows 490 and 494, the exhaust port 468 is important to provide an exit for the noise flow from the motor armature 462 to escape from the lower compartment 456. As represented by the arrows, the suction air 490 is represented by an arrow having one arrow head, cooling air 492 is represented by an arrow having two arrow heads, and noise flow 494 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 460 is housed. The electrical motor operates inside of a vacuum cleaner's negative pressured plenum chamber 456 within the vacuum created by the vacuum cleaner, and thereby, it will greatly reduce the noise level emitted by the motor.

The airflow patterns 490, 492 and 494 are disclosed. Specifically, the suction air flow 490 is sucked into the canister 411 from the intake ports 416 and 414 and as is shown, goes through the filters 446, 448, and 450 and into the pipe 486 and into the center impeller 462 which helps cool the motor as well. The suction air 490 becomes cooling air 492 which goes around the motor and into the motor opening 466 for cooling the motor and substantially reducing the noise level of the motor 460. The noise flow 494 is moved out of the lower compartment 456 by the exhaust horn 464 which is connected to the exhaust port 468.

Figure 7:
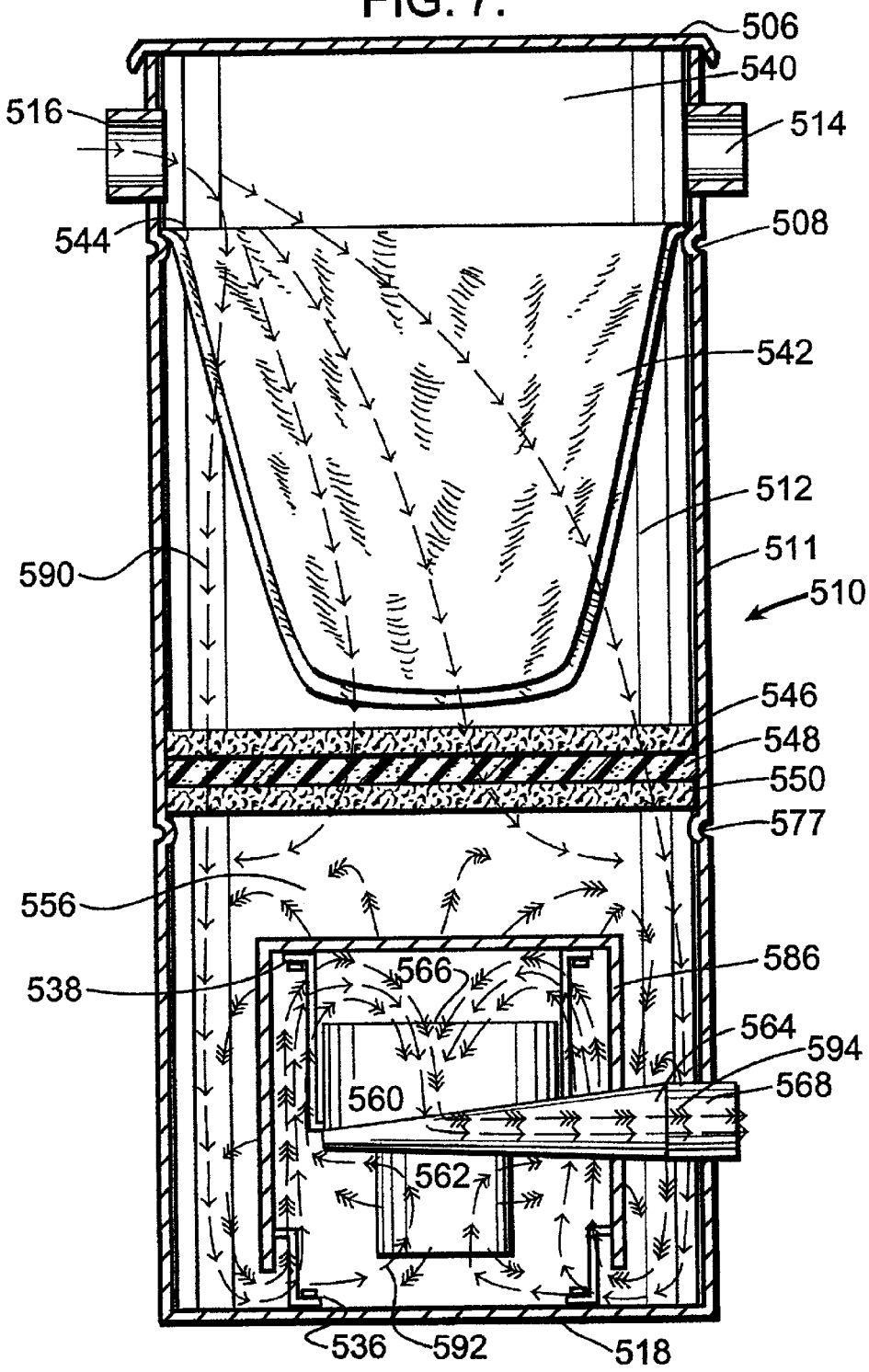
FIG. 7 is an enlarged longitudinal cross-sectional view looking from the front of the central vacuum cleaning system, illustrating a fifth arrangement of the improvements of the present invention therein.

Referring to FIG. 7, there is shown a fifth arrangement of the improvements of the present invention central vacuum cleaning system 510. The canister 511 comprises an upper interior hollow compartment 540 and a lower interior hollow compartment 556. The upper compartment 540 houses within it a removable dirt and dust collection bag 542. The collection bag 542 has an upper rim 544 which rests on an interior ledge 508 of the interior wall of the canister 511. Below the dirt and dust collection bag 542 are a plurality of filters, which include a first mesh or coarse filter 546, a fine or foam filter 548 and a second mesh or coarse filter 550. The first filter 546 rests on top of the foam filter 548 which in turn rests on top of the second filter 550, which in turn all rest on a second interior ledge 577.

As can be seen by the air flow arrows 590 (with only one arrow head), suction created by an electrical motor 560 causes a flow of suction air into the upper interior chamber 540 of the canister 511 and creates a suction which draws dirt, dust and other particulates into the collection bag 542. Since the bag 542 is porous to allow air flow through it, the filters 546, 548 and 550 serve to trap any escaped dirt and dust so that it will not damage the motor 560. The portion described so far are conventional components which are known in prior art central power and suction unit designs.

The present invention central vacuum cleaning system 510 can operate with any plurality of motors within its design. At least one motor 560 and armature 562 is required for the central power and suction unit. Conventionally, either one, two or three motors can be used. In this fifth arrangement of the improvements of the present invention central vacuum cleaning system 510 as illustrated, only one motor 560 is used. The motor 560 is housed in the second interior compartment 556 as shown which lies below the upper interior hollow compartment 540 and is separated from it by the filters. The motor 560 is mounted on the lower side of an air flow baffle plate 586 and spaced apart by an upper bracket 538. The baffle plate 586 surrounds the motor 560 and creates an air flow channel and the impeller 562 and is mounted above and spaced apart from a lower base 518 of the canister 511 by a lower bracket 536. The motor 560 by way of example can be 120 volts, one and one-quarter (1¼) horsepower suction motor. There is provided a motor exhaust horn 564 which extends into the second interior chamber 556 and extends out from the canister sidewall 512 and connects to the exhaust port 568. As can be seen by the flow arrows 590 and 594, the exhaust port 568 is important to provide an exit for the air flow from the motor armature 562 to escape from the canister 511. As represented by the arrows, the suction air 590 is represented by an arrow having one arrow head, cooling air 592 is represented by an arrow having two arrow heads, and noise flow 594 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 560 is housed. The electrical motor operates inside of a vacuum cleaner's negative pressured plenum chamber 556 within the vacuum created by the vacuum cleaner, and thereby, it will greatly reduce the noise level emitted by the motor.

The airflow patterns 590, 592 and 594 are disclosed. Specifically, the suction airflow 590 is sucked into the canister 511 from the intake ports 516 and 514 and as is shown, goes through the filters 546, 548 and 550, and around the air flow baffle plate 586 and into the center impeller 562 which helps cool the motor as well. The suction air 590 becomes cooling air 592 which goes around the motor and into the motor opening 566 for cooling the motor and substantially reducing the noise level of the motor 560. The noise flow 594 is then moved out of the canister 511 by the exhaust horn 564 which is connected to the exhaust port 568.

Figure 8:
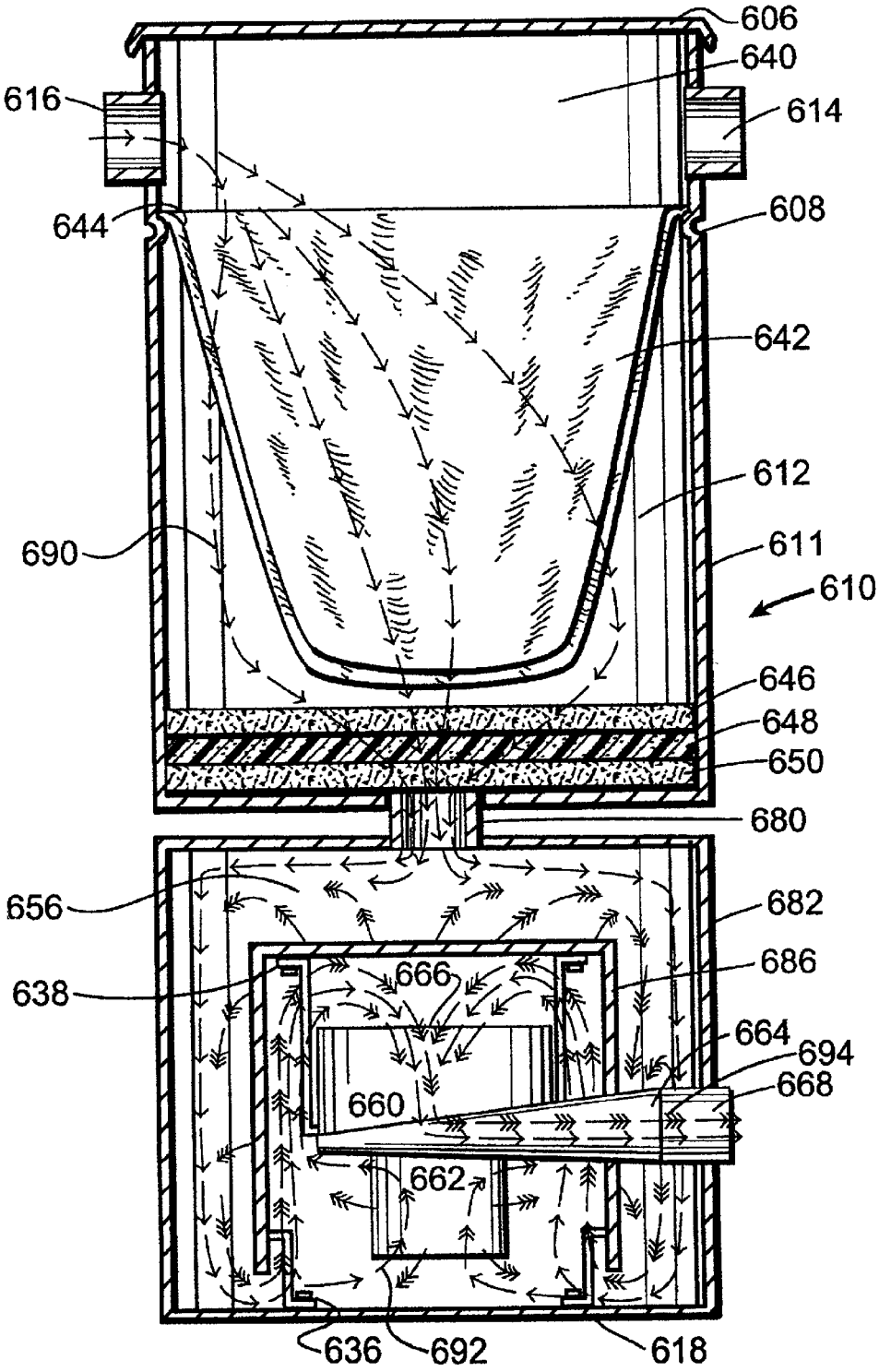
FIG. 8 is an enlarged longitudinal cross-sectional view looking from the front of the central vacuum cleaning system, illustrating a sixth arrangement of the improvements of the present invention therein.

Referring to FIG. 8, there is shown a sixth arrangement of the improvements of the present invention central vacuum cleaning system 610. This sixth arrangement of the improvements of the present invention is very similar to the fifth arrangement discussed above. All of the parts of the sixth arrangement are correspondingly numbered in a 600 series reference number rather than a 500 series reference number used in the fifth arrangement of the present invention. The canister 611 comprises a separate upper interior hollow compartment 640, a separate lower interior hollow compartment 656 and a neck joint 680 which connects the upper and lower compartments together. The upper compartment 640 houses within it a removable dirt and dust collection bag 642. The collection bag 642 has an upper rim 644 which rests on an interior ledge 608 of the interior wall of the canister 611. Below the dirt and dust collection bag 642 are a plurality of filters, which include a first mesh or coarse filter 646, a fine or foam filter 648 and a second mesh or coarse filter 650. The first filter 646 rests on top of the foam filter 648 which in turn rests on top of the second filter 650, which in turn all rest on the bottom of the upper interior compartment 640.

As can be seen by the suction air flow arrows 690 (with only one arrow head), suction created by an electrical motor 660 causes a flow of air into the upper interior compartment 640 of the canister 611 and creates a suction which draws dirt, dust and other particulates into the collection bag 642. Since the bag 642 is porous to allow air flow through it, the filters 646, 648 and 650 serve to trap any escaped dirt and dust so that it will not damage the motor 660. The portion described so far are conventional components which are known in prior art central power and suction unit designs.

The present invention central vacuum cleaning system 610 can operate with any plurality of motors within its design. At least one motor 660 and armature 662 is required for the central power and suction unit. Conventionally, either one, two or three motors can be used. In this sixth arrangement of the improvements of the present invention central vacuum cleaning system 610 as illustrated, only one motor 660 is used. The motor 660 is housed in the second interior compartment 656 as shown which lies below the upper interior hollow compartment 640. The motor 660 is mounted on the lower side of a baffle 686 and spaced apart therefrom by an upper bracket 638. The baffle 686 surrounds the motor 660 and the impeller 662 and is mounted above and spaced apart from a lower base 618 of the lower compartment 656 of the canister 611 by a lower bracket 636. The motor 660 by way of example can be 120 volts, one and one-quarter (1¼) horsepower suction motor. There is provided a motor exhaust horn 664 which extends into the second interior compartment 656 and extends out from the sidewall 682 of the lower compartment 656 and connects to the exhaust port 668. As can be seen by the flow arrows 690 and 694, the exhaust port 668 is important to provide an exit for the noise flow from the motor armature 662 to escape from the lower compartment 656. As represented by the arrows, the suction air 690 is represented by an arrow having one arrow head, cooling air 692 is represented by an arrow having two arrow heads, and noise flow 694 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 660 is housed. The electrical motor operates inside of a vacuum cleaner's negative pressured plenum chamber 656 within the vacuum created by the vacuum cleaner, and thereby, it will greatly reduce the noise level emitted by the motor.

The airflow patterns 690, 692 and 694 are disclosed. Specifically, the suction airflow 690 is sucked into the canister 611 from the intake ports 616 and 614 and as is shown, goes through the filters 646, 648, and 650 and into the neck joint 680 and around the baffle 686 and into the center impeller 662 which helps cool the motor as well. The suction air 690 becomes cooling air 692 which goes around the motor and into the motor opening 666 for cooling the motor and substantially reducing the noise level of the motor 660. The noise flow 694 is moved out of the lower compartment 656 by the exhaust horn 664 which is connected to the exhaust port 668.

Figure 9:
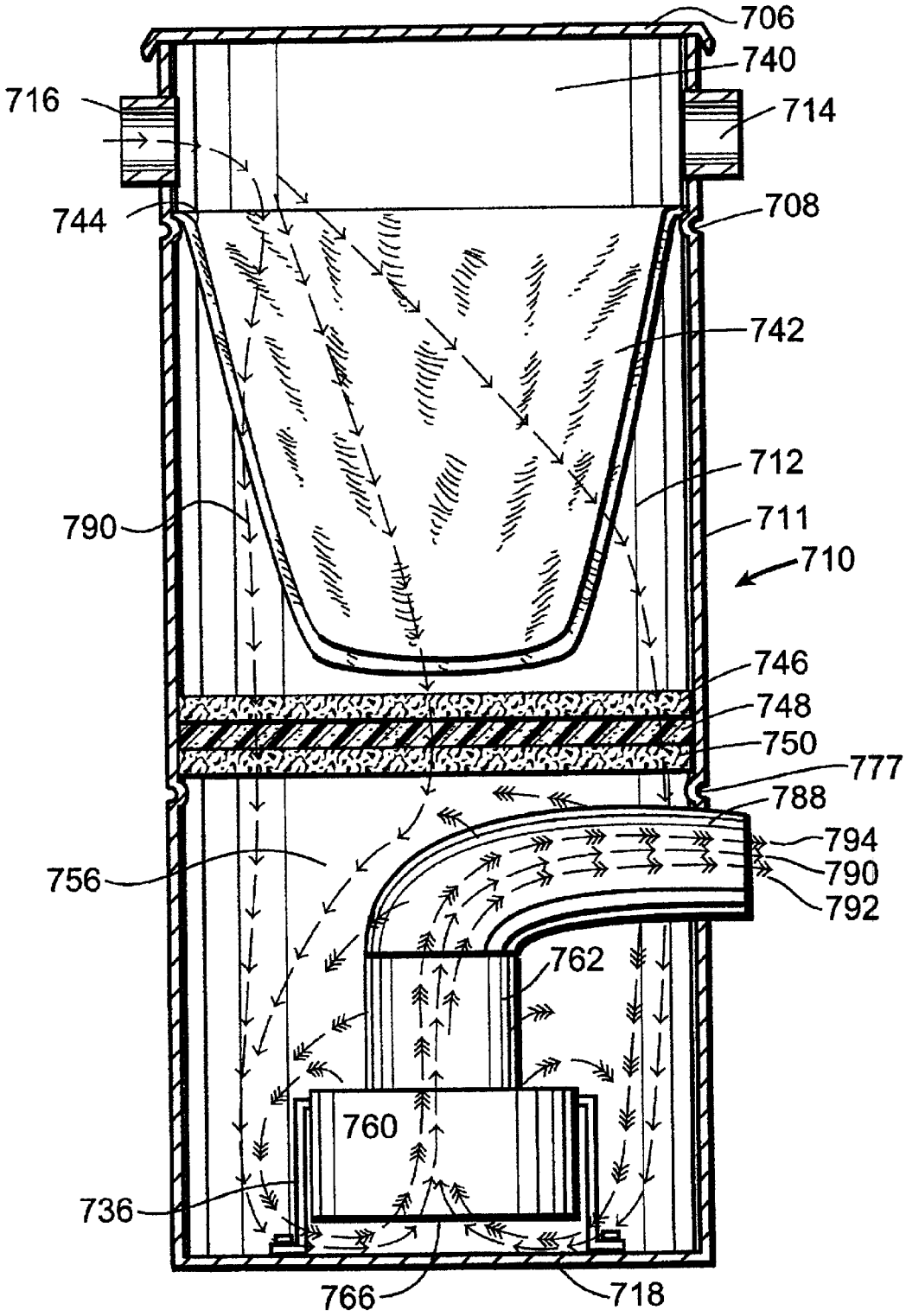
FIG. 9 is an enlarged longitudinal cross-sectional view looking from the front of the central vacuum cleaning system, illustrating a seventh arrangement of the improvements of the present invention therein.

Referring to FIG. 9, there is shown a seventh arrangement of the improvements of the present invention central vacuum cleaning system 710. The canister 711 comprises an upper interior hollow compartment 740 and a lower interior hollow compartment 756. The upper compartment 740 houses within it a removable dirt and dust collection bag 742. The collection bag 742 has an upper rim 744 which rests on an interior ledge 708 of the interior wall of the canister 711. Below the dirt and dust collection bag 742 are a plurality of filters, which include a first mesh or coarse filter 746, a fine or foam filter 748 and a second mesh or coarse filter 750. The first filter 746 rests on top of the foam filter 748 which in turn rests on top of the second filter 750, which in turn all rest on a second interior ledge 777.

As can be seen by the airflow arrows 790 (with only one arrow head), suction created by an electrical motor 760 causes a flow of suction air into the upper interior chamber 740 of the canister 711 and creates a suction which draws dirt, dust and other particulates into the collection bag 742. Since the bag 742 is porous to allow air flow through it, the filters 746, 748 and 750 serve to trap any escaped dirt and dust so that it will not damage the motor 760. The portion, described so far are conventional components which are known in prior art central power and suction unit designs.

The present invention central vacuum cleaning system 710 can operate with any plurality of motors within its design. At least one motor 760 and armature 762 is required for the central power and suction unit. Conventionally, either one, two or three motors can be used. In this seventh arrangement of the improvements of the present invention central vacuum cleaning system 710 as illustrated, only one motor 760 is used. The motor 760 is housed in the second interior compartment 756 as shown which lies below the upper interior hollow compartment 740 and is separated from it by the filters. The motor 760 is mounted above and spaced apart from a lower base 718 of the canister 711 by a bracket 736. The motor 760 by way of example can be 120 volts, one and one-quarter (1¼) horsepower suction motor. There is provided a cooling exhaust pipe 788 which extends into the second interior chamber 756 and connects to the motor armature 762. The cooling exhaust pipe 788 further extends out from the canister sidewall 712. As can be seen by the flow arrows 790, 792 and 794, the cooling exhaust pipe 788 is important to provide an exit for the airflow from the motor armature 762 to escape from the canister 711. As represented by the arrows, the suction air 790 is represented by an arrow having one arrow head, cooling air 792 is represented by an arrow having two arrow heads, and noise flow 794 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 760 is housed. The electrical motor operates inside of a vacuum cleaner's negative pressured plenum chamber 756 within the vacuum created by the vacuum cleaner, and thereby, it will greatly reduce the noise level emitted by the motor.

The airflow patterns 790, 792 and 794 are disclosed. Specifically, the suction air flow 790 is sucked into the canister 711 from the intake ports 716 and 714 and as is shown, goes through the filters 746, 748, and 750. The suction air 790 becomes cooling air 792 which goes around the motor and into the motor opening 766 for cooling the motor and substantially reducing the noise level of the motor 760. The suction air 790, cooling air 792 and noise flow 794 are moved out of the canister 711 by the cooling exhaust pipe 788.

Figure 10:
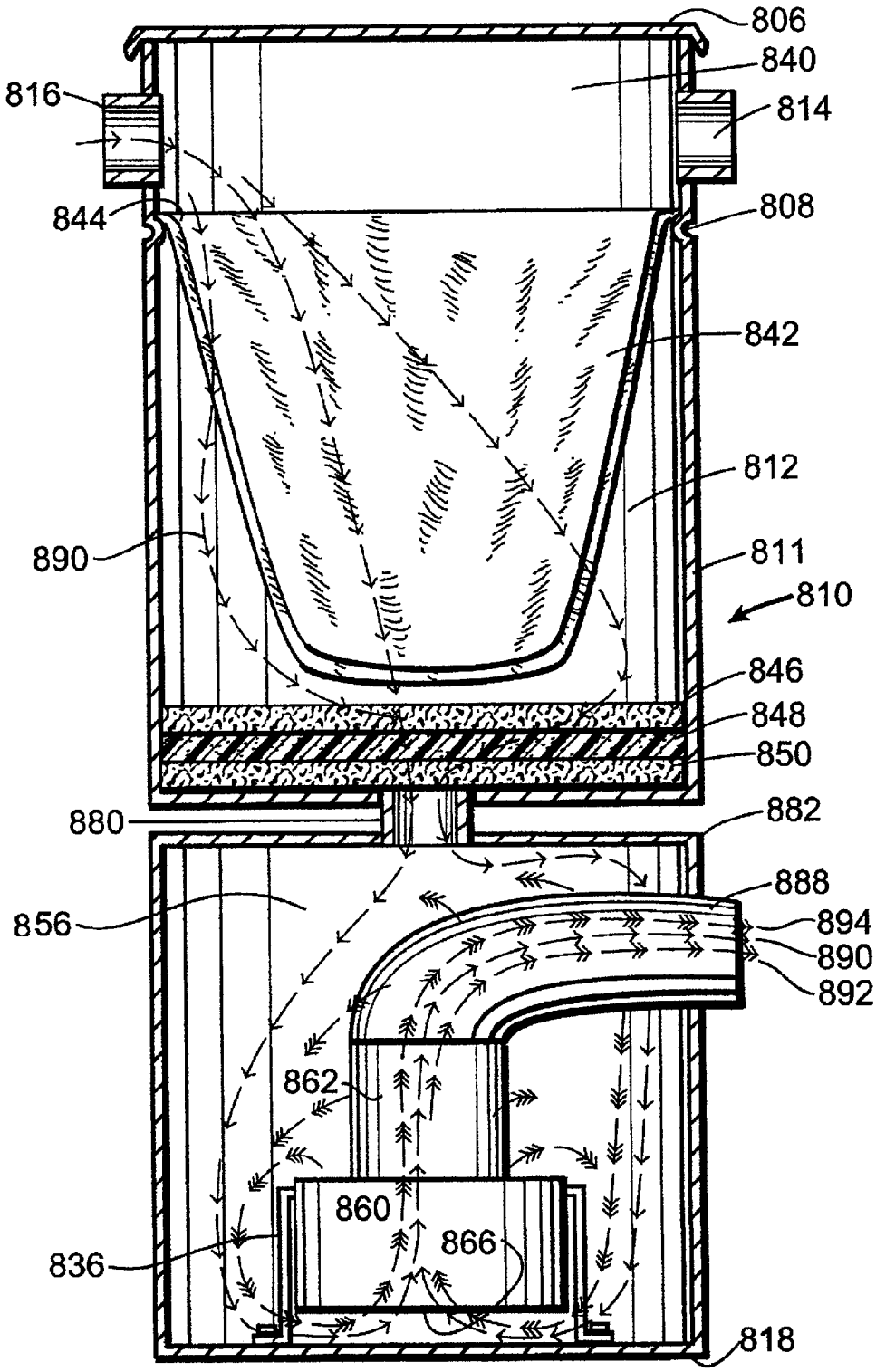
FIG. 10 is an enlarged longitudinal cross-sectional view looking from the front of the central vacuum cleaning system, illustrating an eighth arrangement of the improvements of the present invention therein.

Referring to FIG. 10, there is shown an eighth arrangement of the improvements of the present invention central vacuum cleaning system 810. The canister 811 comprises a separate upper interior hollow compartment 840, a separate lower interior hollow compartment 856 and a neck joint 880 which connects the upper and lower compartments together. The upper compartment 840 houses within it a removable dirt and dust collection bag 842. The collection bag 842 has an upper rim 844 which rests on an interior ledge 808 of the interior wall of the canister 811. Below the dirt and dust collection bag 842 are a plurality of filters, which include a first mesh or coarse filter 846, a fine or foam filter 848 and a second mesh or coarse filter 850. The first filter 846 rests on top of the foam filter 848 which in turn rests on top of the second filter 850, which in turn all rest on the bottom of the upper interior compartment 840.

As can be seen by the airflow arrows 890 (with only one arrow head), suction created by an electrical motor 860 causes a flow of suction air into the upper interior chamber 840 of the canister 811 and creates a suction which draws dirt, dust and other particulates into the collection bag 842. Since the bag 842 is porous to allow air flow through it, the filters 846, 848 and 850 serve to trap any escaped dirt and dust so that it will not damage the motor 860. The portion described so far are conventional components which are known in prior art central power and suction unit designs.

The present invention central vacuum cleaning system 810 can operate with any plurality of motors within its design. At least one motor 860 and armature 862 is required for the central power and suction unit. Conventionally, either one, two or three motors can be used. In this eighth arrangement of the improvements of the present invention central vacuum cleaning system 810 as illustrated, only one motor 860 is used. The motor 860 is housed in the tower interior compartment 856 as shown which lies below the upper interior compartment 840. The motor 860 is mounted above and spaced apart from a lower base 818 of the lower compartment 856 by a bracket 836. The motor 860 by way of example can be 120 volts, one and one-quarter (1¼) horsepower suction motor. There is provided a cooling exhaust pipe 888 which extends into the second interior chamber 856 and connects to the motor armature 862. The cooling exhaust pipe 888 further extends out from the lower canister sidewall 882. As can be seen by the flow arrows 890, 892 and 894, the cooling exhaust pipe 888 is important to provide an exit for the airflow from the motor armature 862 to escape from the lower compartment 856. As represented by the arrows, the suction air 890 is represented by an arrow having one arrow head, cooling air 892 is represented by an arrow having two arrow heads, and noise flow 894 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 860 is housed. The electrical motor operates inside of a vacuum cleaner's negative pressured plenum chamber 856 within the vacuum created by the vacuum cleaner, and thereby, it will greatly reduce the noise level emitted by the motor.

The airflow patterns 890, 892 and 894 are disclosed. Specifically, the suction air flow 890 is sucked into the canister 811 from the intake ports 816 and 814 and as is shown, goes through the filters 846, 848, and 850. The suction air 890 becomes cooling air 892 which goes around the motor and into the motor opening 866 for cooling the motor and substantially reducing the noise level of the motor 860. The suction air 890, cooling air 892 and noise flow 894 are moved out of the lower compartment 856 by the cooling exhaust pipe 888.

Figure 11:
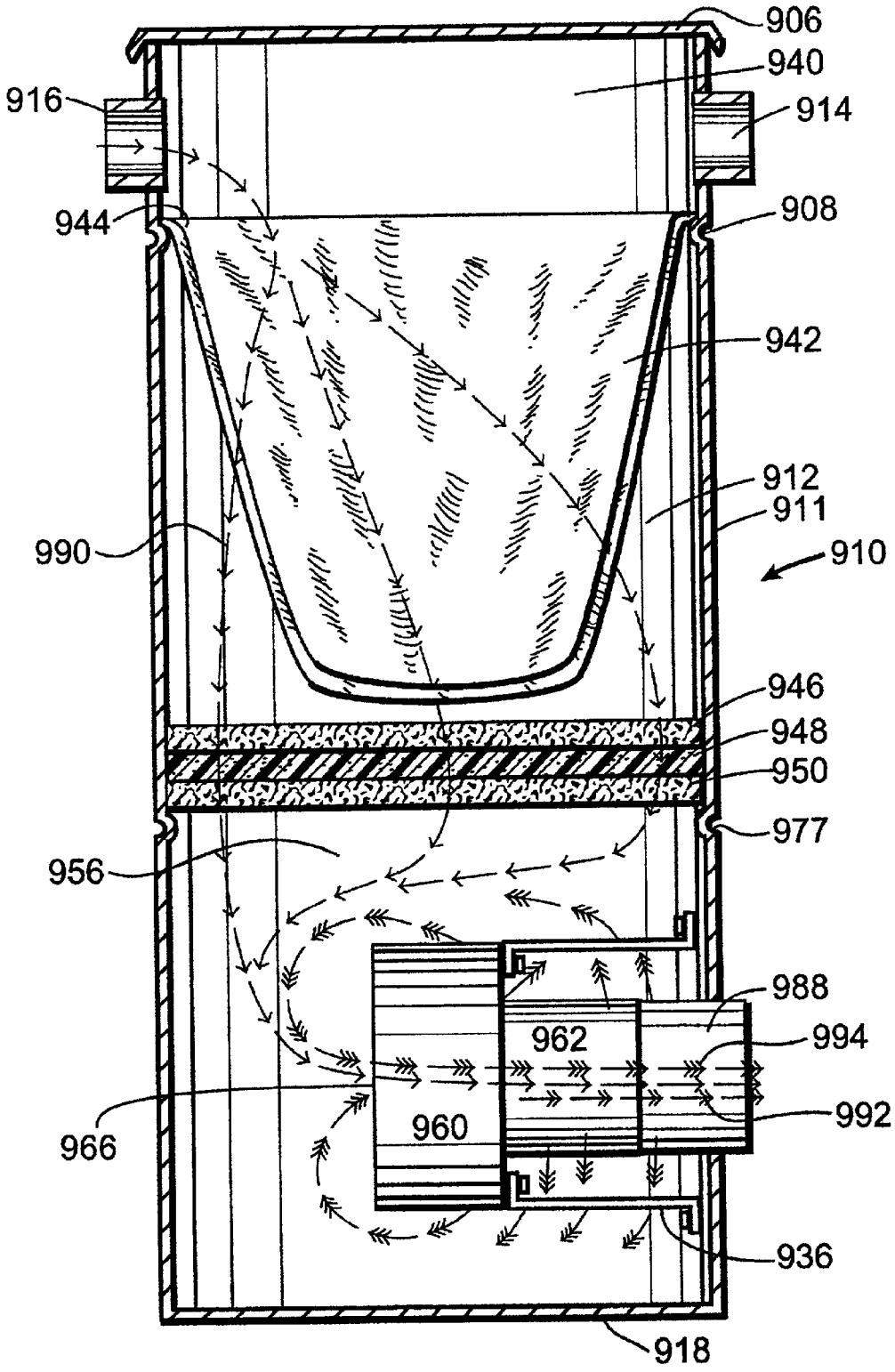
FIG. 11 is an enlarged longitudinal cross-sectional view looking from the front of the central vacuum cleaning system, illustrating a ninth arrangement of the improvements of the present invention therein.

Referring to FIG. 11, there is shown a ninth arrangement of the improvements of the present invention central vacuum cleaning system 910. The canister 911 comprises an upper interior hollow compartment 940 and a lower interior hollow compartment 956. The upper compartment 940 houses within it a removable dirt and dust collection bag 942. The collection bag 942 has an upper rim 944 which rests on an interior ledge 908 of the interior wall of the canister 911. Below the dirt and dust collection bag 942 are a plurality of filters, which include a first mesh or coarse filter 946, a fine or foam filter 948 and a second mesh or coarse filter 950. The first filter 946 rests on top of the foam filter 948 which in turn rests on top of the second filter 950, which in turn all rest on a second interior ledge 977.

As can be seen by the airflow arrows 990 (with only one arrow head), suction created by an electrical motor 960 causes a flow of suction air into the upper interior chamber 940 of the canister 911 and creates a suction which draws dirt, dust and other particulates into the collection bag 942. Since the bag 942 is porous to allow air flow through it, the filters 946, 948 and 950 serve to trap any escaped dirt and dust so that it will not damage the motor 960. The portion described so far are conventional components which are known in prior art central power and suction unit designs.

The present invention central vacuum cleaning system 910 can operate with any plurality of motors within its design. At least one motor 960 and armature 962 is required for the central power and suction unit. Conventionally, either one, two or three motors can be used. In this first arrangement of the improvements of the present invention central vacuum cleaning system 910 as illustrated, only one motor 960 is used. The motor 960 is housed in the second interior compartment 956 as shown which lies below the upper interior hollow compartment 940 and is separated from it by the filters. The motor 960 is mounted spaced apart from the sidewall 912 of the canister 911 by a bracket 936. The motor 960 by way of example can be 120 volts, one and one-quarter (1¼) horsepower suction motor. There is provided a cooling exhaust pipe 988 which has one end extending out from the sidewall 912 of the canister 911 and the other end covering the impeller 962 of the motor 960. As can be seen by the flow arrows 990, 992 and 994, the cooling exhaust pipe 988 is important to provide an exit for the airflow from the motor armature 962 to escape from the canister 911. As represented by the arrows, the suction air 990 is represented by an arrow having one arrow head, cooling air 992 is represented by an arrow having two arrow heads, and noise flow 994 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 960 is housed. The electrical motor operates inside of a vacuum cleaner's negative pressured plenum chamber 956 within the vacuum created by the vacuum cleaner, and thereby, it will greatly reduce the noise level emitted by the motor.

The airflow patterns 990, 992 and 994 are disclosed. Specifically, the suction airflow 990 is sucked into the canister 911 from the intake ports 916 and 914 and as is shown, goes through the filters 946, 948 and 950, and into the motor opening 966 by the center impeller 962 which helps cool the motor as well. The suction air 990 becomes cooling air 992 which goes around the motor for cooling the motor and substantially reducing the noise level generated by the motor 960. The noise flow 994 is moved out of the canister 911 via of the cooling exhaust pipe 988.

Figure 12:
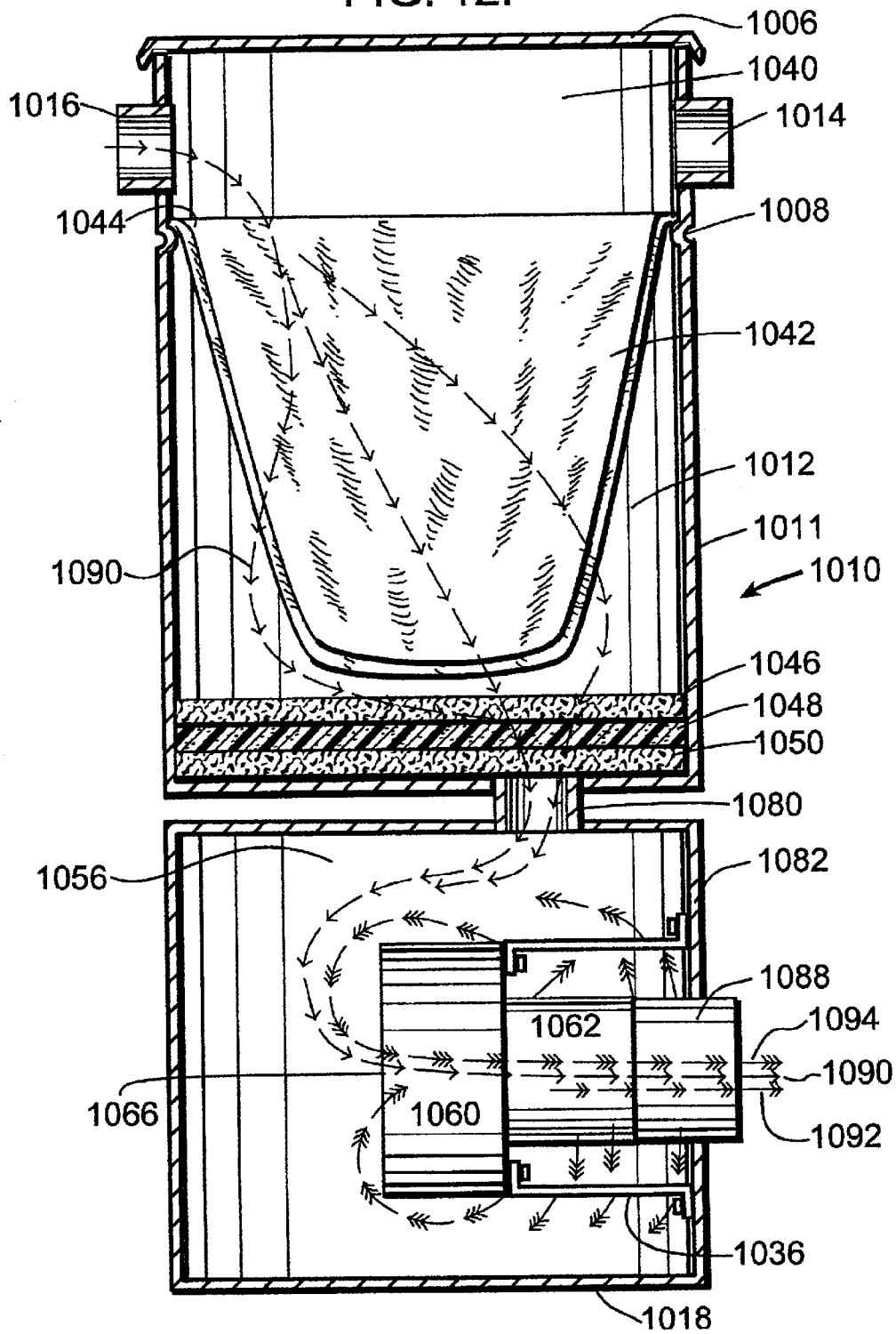
FIG. 12 is an enlarged longitudinal cross-sectional view looking from the front of the central vacuum cleaning system, illustrating a tenth arrangement of the improvements of the present invention therein.

Referring to FIG. 12, there is shown a tenth arrangement of the improvements of the present invention central vacuum cleaning system 1010. The canister 1011 comprises a separate upper interior hollow compartment 1040, a separate lower interior hollow compartment 1056 and a neck joint 1080 which connects the upper and lower compartments together. The upper compartment 1040 houses within it a removable dirt and dust collection bag 1042. The collection bag 1042 has an upper rim 1044 which rests on an interior ledge 1008 of the interior wall of the canister 1011. Below the dirt and dust collection bag 1042 are a plurality of filters, which include a first mesh or coarse filter 1046, a fine or foam filter 1048 and a second mesh or coarse filter 1050. The first filter 1046 rests on top of the foam filter 1048 which in turn rests on top of the second filter 1050, which in turn all rest on the bottom of the upper interior compartment 1040.

As can be seen by the airflow arrows 1090 (with only one arrow head), suction created by an electrical motor 1060 causes a flow of suction air into the upper interior chamber 1040 of the canister 1011 and creates a suction which draws dirt, dust and other particulates into the collection bag 1042. Since the bag 1042 is porous to allow airflow through it, the filters 1046, 1048 and 1050 serve to trap any escaped dirt and dust so that it will not damage the motor 1060. The portion described so far are conventional components which are known in prior art central power and suction unit designs.

The present invention central vacuum cleaning system 1010 can operate with any plurality of motors within its design. At least one motor 1060 and armature 1062 is required for the central power and suction unit. Conventionally, either one, two or three motors can be used. In this tenth arrangement of the improvements of the present invention central vacuum cleaning system 1010 as illustrated, only one motor 1060 is used. The motor 1060 is housed in the second interior compartment 1056 as shown which lies below the upper interior hollow compartment 1040. The motor 1060 is mounted spaced apart from the lower canister sidewall 1082 by a bracket 1036. The motor 1060 by way of example can be 120 volts, one and one-quarter (1¼) horsepower suction motor. There is provided a cooling exhaust pipe 1088 which has one end extending out from the sidewall 1082 and the other end covering the impeller 1062 of the motor 1060. As can be seen by the flow arrows 1090, 1092 and 1094, the cooling exhaust pipe 1088 is important to provide an exit for the airflow from the motor armature 1062 to escape from the lower compartment 1056 of canister 1011. As represented by the arrows, the suction air 1090 is represented by an arrow having one arrow head, cooling air 1092 is represented by an arrow having two arrow heads, and noise flow 1094 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 1060 is housed. The electrical motor operates inside of a vacuum cleaner's negative pressured plenum chamber 1056 within the vacuum created by the vacuum cleaner, and thereby, it will greatly reduce the noise level emitted by the motor.

The airflow patterns 1090, 1092 and 1094 are disclosed. Specifically, the suction airflow 1090 is sucked into the canister 1011 from the intake ports 1016 and 1014 and as is shown, goes through the filters 1046, 1048 and 1050, and through the neck joint 1080 and into the motor opening 1066 by the center impeller 1062 which helps cool the motor as well. The suction air 1090 becomes cooling air 1092 which goes around the motor for cooling the motor and substantially reducing the noise level generated by the motor 1060. The noise flow 1094 is moved out of the lower compartment 1056 via of the cooling exhaust pipe 1088.

Figure 13:
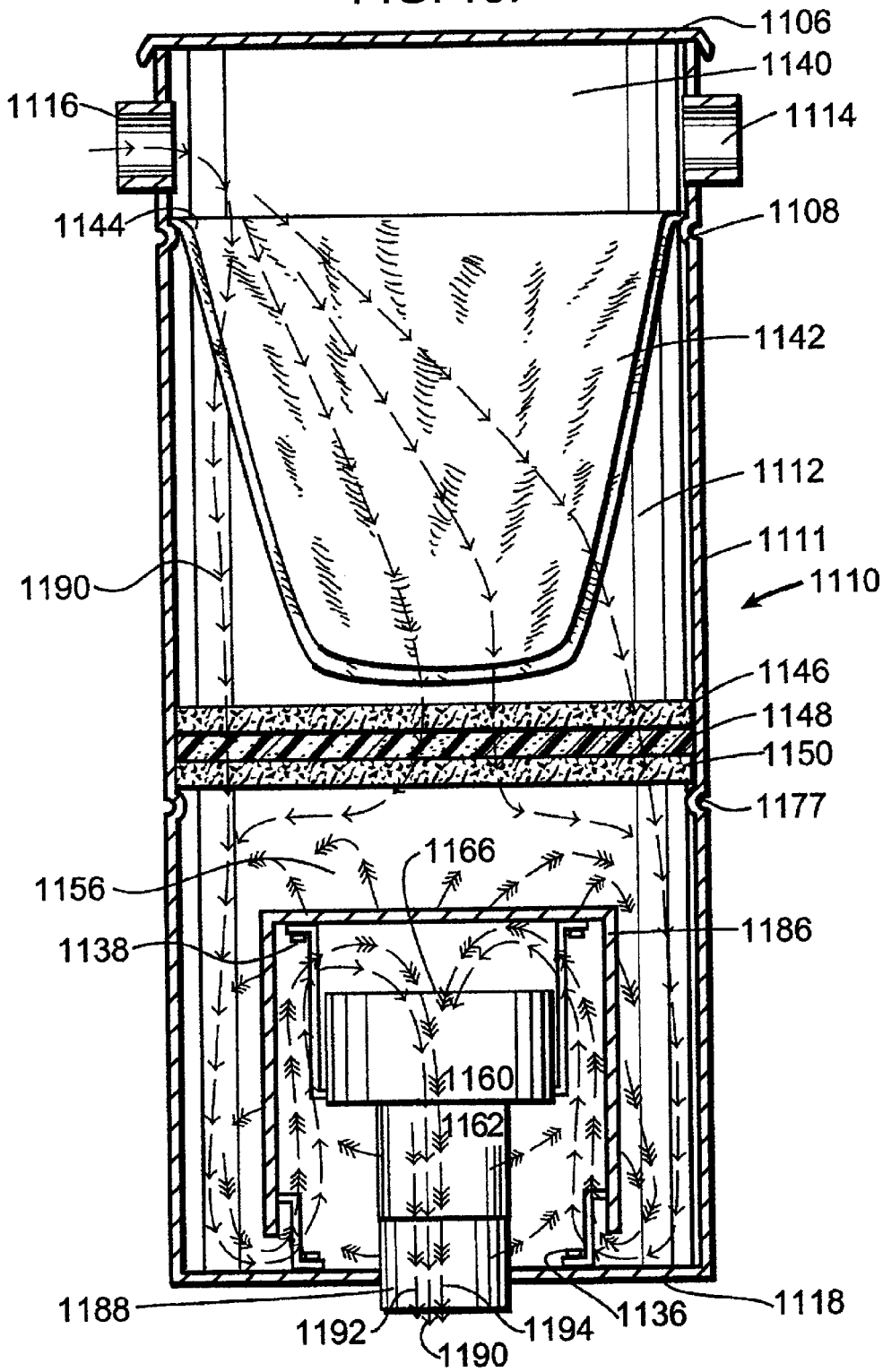
FIG. 13 is an enlarged longitudinal cross-sectional view looking from the front of the central vacuum cleaning system, illustrating an eleventh arrangement of the improvements of the present invention therein.

Referring to FIG. 13, there is shown an eleventh arrangement of the improvements of the present invention central vacuum cleaning system 1110. The canister 1111 comprises an upper interior hollow compartment 1140 and a lower interior hollow compartment 1156. The upper compartment 1140 houses within it a removable dirt and dust collection bag 1142. The collection bag 1142 has an upper rim 1144 which rests on an interior ledge 1108 of the interior wall of the canister 1111. Below the dirt and dust collection bag 1142 are a plurality of filters, which include a first mesh or coarse filter 1146, a fine or foam filter 1148 and a second mesh or coarse filter 1150. The first filter 1146 rests on top of the foam filter 1148 which in turn rests on top of the second filter 1150, which in turn all rest on a second interior ledge 1177.

As can be seen by the air flow arrows 1190 (with only one arrow head), suction created by an electrical motor 1160 causes a flow of suction air into the upper interior chamber 1140 of the canister 1111 and creates a suction which draws dirt, dust and other particulates into the collection bag 1142. Since the bag 1142 is porous to allow air flow through it, the filters 1146, 1148 and 1150 serve to trap any escaped dirt and dust so that it will not damage the motor 1160. The portion described so far are conventional components which are known in prior art central power and suction unit designs.

The present invention central vacuum cleaning system 1110 can operate with any plurality of motors within its design. At least one motor 1160 and armature 1162 is required for the central power and suction unit. Conventionally, either one, two or three motors can be used. In this eleventh arrangement of the improvements of the present invention central vacuum cleaning system 1110 as illustrated, only one motor 1160 is used. The motor 1160 is housed in the second interior compartment 1156 as shown which lies below the upper interior hollow compartment 1140 and is separated from it by the filters. The motor 1160 is mounted on the lower side of a baffle 1186 and spaced apart by an upper bracket 1138. The baffle 1186 surrounds the motor 1160 and the impeller 1162 and is mounted above and spaced apart from a lower base 1118 of the canister 1111 by a lower bracket 1136. The motor 1160 by way of example can be 120 volts, one and one-quarter (1¼) horsepower suction motor. There is provided a cooling exhaust pipe 1188 which has one end extending out from a lower base 1118 of the canister 1111 and the other end covering the impeller 1162 of the motor 1160. As can be seen by the flow arrows 1190, 1192 and 1194, the cooling exhaust pipe 1188 is important to provide an exit for the airflow from the motor armature 1162 to escape from the canister 1111. As represented by the arrows, the suction air 1190 is represented by an arrow having one arrow head, cooling air 1192 is represented by an arrow having two arrow heads, and noise flow 1194 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 1160 is housed. The electrical motor operates inside of a vacuum cleaner's negative pressured plenum chamber 1156 within the vacuum created by the vacuum cleaner, and thereby, it will greatly reduce the noise level emitted by the motor.

The airflow patterns 1190, 1192 and 1194 are disclosed. Specifically, the suction airflow 1190 is sucked into the canister 1111 from the intake ports 1116 and 1114 and as is shown, goes through the filters 1146, 1148 and 1150, and around the air flow baffle 1186 and into the motor opening 1166 by the center impeller 1162 which helps cool the motor as well. The suction air 1190 becomes cooling air 1192 which goes through the motor for cooling the motor and substantially reducing the noise level generated by the motor 1160. The noise flow 1194 is then moved out of the canister 1111 by the cooling exhaust pipe 1188.

Figure 14:
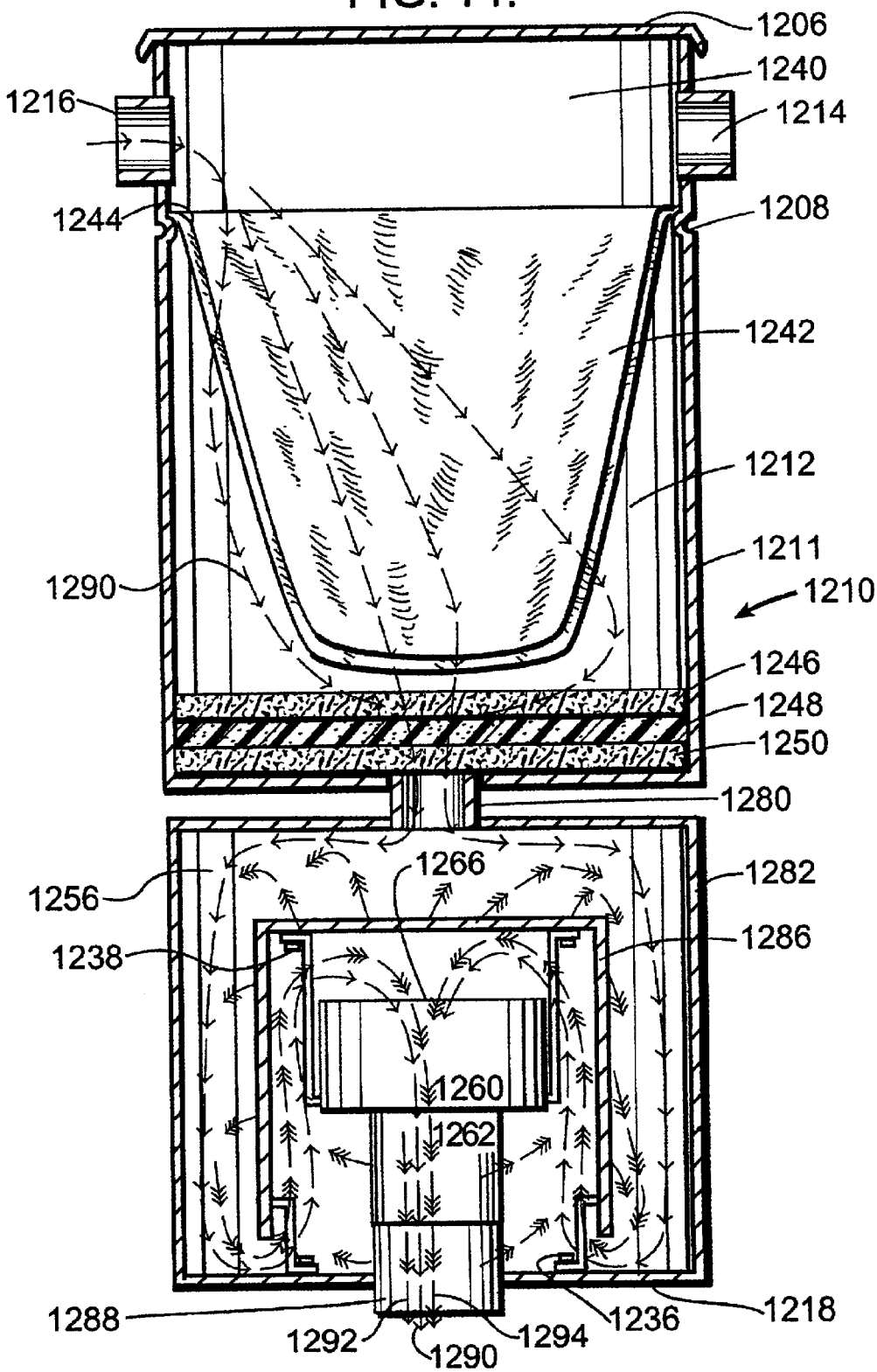
FIG. 14 is an enlarged longitudinal cross-sectional view looking from the front of the central vacuum cleaning system, illustrating a twelfth arrangement of the improvements of the present invention therein.

Referring to FIG. 14, there is shown a twelfth arrangement of the improvements of the present invention central vacuum cleaning system 1210. The canister 1211 comprises a separate upper interior hollow compartment 1240, a separate lower interior hollow compartment 1256 and a neck joint 1280 which connects the upper and lower compartments together. The upper compartment 1240 houses within it a removable dirt and dust collection bag 1242. The collection bag 1242 has an upper rim 1244 which rests on an interior ledge 1208 of the interior wall of the canister 1211. Below the dirt and dust collection bag 1242 are a plurality of filters, which include a first mesh or coarse filter 1246, a fine or foam filter 1248 and a second mesh or coarse filter 1250. The first filter 1246 rests on top of the foam filter 1248 which in turn rests on top of the second filter 1250, which in turn all rest on the bottom of the upper compartment 1240.

As can be seen by the air flow arrows 1290 (with only one arrow head), suction created by an electrical motor 1260 causes a flow of suction air into the upper interior chamber 1240 of the canister 1211 and creates a suction which draws dirt, dust and other particulates into the collection bag 1242. Since the bag 1242 is porous to allow air flow through it, the filters 1246, 1248 and 1250 serve to trap any escaped dirt and dust so that it will not damage the motor 1260. The portion described so far are conventional components which are known in prior art central power and suction unit designs.

The present invention central vacuum cleaning system 1210 can operate with any plurality of motors within its design. At least one motor 1260 and armature 1262 is required for the central power and suction unit. Conventionally, either one, two or three motors can be used. In this twelfth arrangement of the improvements of the present invention central vacuum cleaning system 1210 as illustrated, only one motor 1260 is used. The motor 1260 is housed in the second interior compartment 1256 as shown which lies below the upper interior hollow compartment 1240. The motor 1260 is mounted on the lower side of an air flow baffle plate 1286 and spaced apart by an upper bracket 1238. The baffle plate 1286 surrounds the motor 1260 and the impeller 1262 and is mounted above and spaced apart from a lower base 1218 of the lower compartment 1256 of canister 1211 by a lower bracket 1236. The motor 1260 by way of example can be 120 volts, one and one-quarter (1¼) horsepower suction motor. There is provided a cooling exhaust pipe 1288 which has one end extending out from the lower base 1218 of the canister 1211 and the other end covering the impeller 1262 of the motor 1260. As can be seen by the flow arrows 1290, 1292 and 1294, the cooling exhaust pipe 1288 is important to provide an exit for the airflow from the motor armature 1262 to escape from the lower compartment 1256 of canister 1211. As represented by the arrows, the suction air 1290 is represented by an arrow having one arrow head, cooling air 1292 is represented by an arrow having two arrow heads, and noise flow 1294 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 1260 is housed. The electrical motor operates inside of a vacuum cleaner's negative pressured plenum chamber 1256 within the vacuum created by the vacuum cleaner, and thereby, it will greatly reduce the noise level emitted by the motor.

The airflow patterns 1290, 1292 and 1294 are disclosed. Specifically, the suction airflow 1290 is sucked into the canister 1211 from the intake ports 1216 and 1214 and as is shown, goes through the filters 1246, 1248 and 1250, and around the air flow baffle plate 1286 and into the motor opening 1266 by the center impeller 1262 which helps cool the motor as well. The suction air 1290 becomes cooling air 1292 which goes through the motor for cooling the motor and substantially reducing the noise level generated by the motor 1260. The noise flow 1294 is then moved out of the lower compartment 1256 of canister 1211 by the cooling exhaust pipe 1288.

Figure 15:
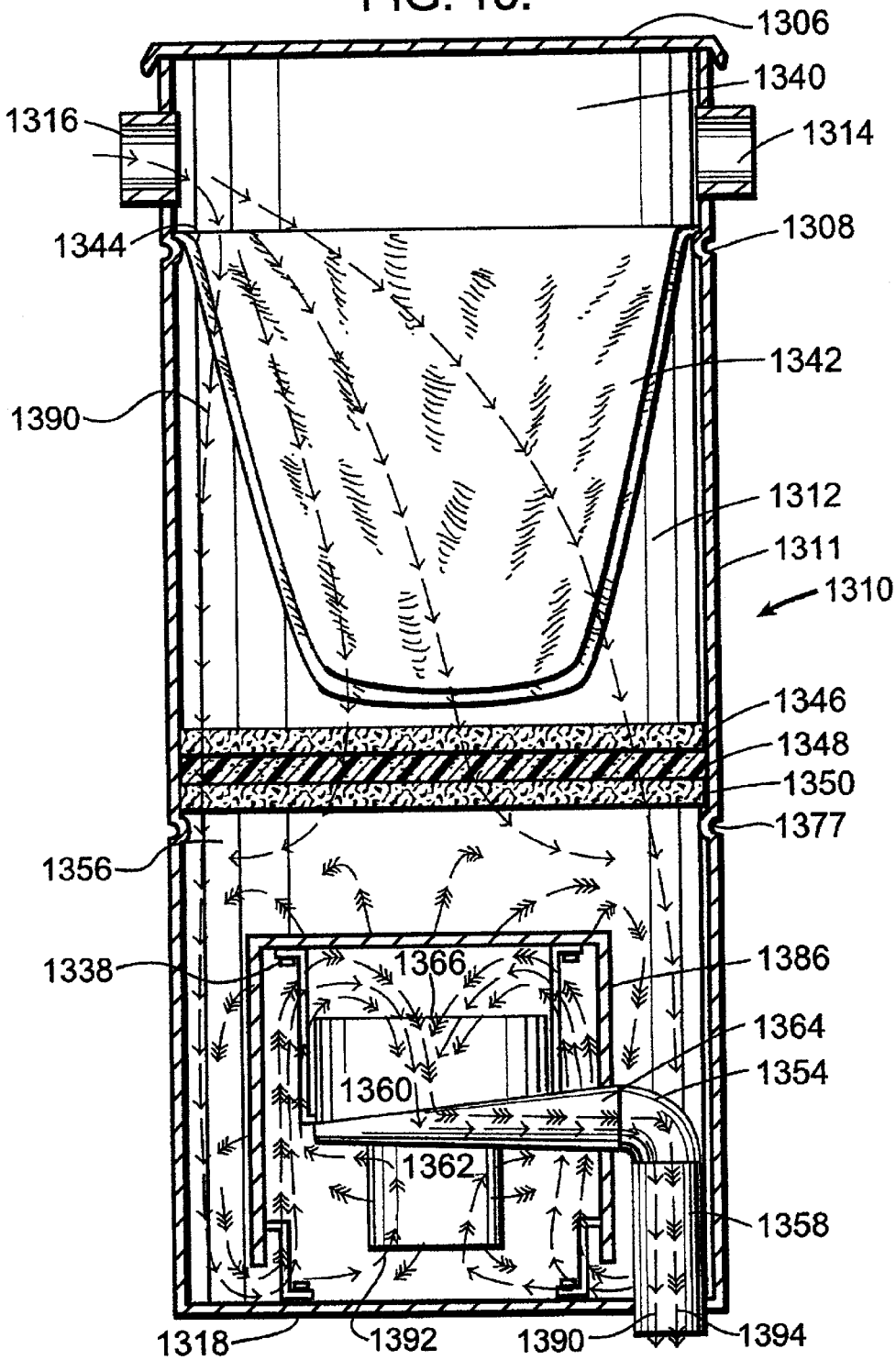
FIG. 15 is an enlarged longitudinal cross-sectional view looking from the front of the central vacuum cleaning system, illustrating a thirteenth arrangement of the improvements of the present invention therein.

Referring to FIG. 15, there is shown a thirteen arrangement of the improvements of the present invention central vacuum cleaning system 1310. The canister 1311 comprises an upper interior hollow compartment 1340 and a lower interior hollow compartment 1356. The upper compartment 1340 houses within it a removable dirt and dust collection bag 1342. The collection bag 1342 has an upper rim 1344 which rests on an interior ledge 1308 of the interior wall of the canister 1311. Below the dirt and dust collection bag 1342 are a plurality of filters, which include a first mesh or coarse filter 1346, a fine or foam filter 1348 and a second mesh or coarse filter 1350. The first filter 1346 rests on top of the foam filter 1348 which in turn rests on top of the second filter 1350, which in turn all rest on a second interior ledge 1377.

As can be seen by the airflow arrows 1390 (with only one arrow head), suction created by an electrical motor 1360 causes a flow of suction air into the upper interior chamber 1340 of the canister 1311 and creates a suction which draws dirt, dust and other particulates into the collection bag 1342. Since the bag 1342 is porous to allow air flow through it, the filters 1346, 1348 and 1350 serve to trap any escaped dirt and dust so that it will not damage the motor 1360. The portion described so far are conventional components which are known in prior art central power and suction unit designs.

The present invention central vacuum cleaning system 1310 can operate with any plurality of motors within its design. At least one motor 1360 and armature 1362 is required for the central power and suction unit. Conventionally, either one, two or three motors can be used. In this thirteenth arrangement of the improvements of the present invention central vacuum cleaning system 1310 as illustrated, only one motor 1360 is used. The motor 1360 is housed in the lower interior compartment 1356 as shown which lies below the upper interior hollow compartment 1340 and is separated from it by the filters. The motor 1360 is mounted on the lower side of an air flow baffle plate 1386 and spaced apart by an upper bracket 1338. The baffle plate 1386 surrounds the motor 1360 and the impeller 1362 and is mounted above and spaced apart from a lower base 1318 of the canister 1311 by a lower bracket 1336. The motor 1360 by way of example can be 120 volts, one and one-quarter (1¼) horsepower suction motor. There is provided a motor exhaust horn 1364 which extends into the lower interior chamber 1356. The motor exhaust horn 1364 is connected to an exhaust elbow 1354 which in turn is connected to an exhaust tube 1358 that extends out from a lower base 1318 of the canister 1311. As can be seen by the flow arrows 1390 and 1394, the exhaust tube 1358 is important to provide an exit for the airflow from the motor armature 1362 to escape from the canister 1311. As represented by the arrows, the suction air 1390 is represented by an arrow having one arrow head, cooling air 1392 is represented by an arrow having two arrow heads, and noise flow 1394 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 1360 is housed. The electrical motor operates inside of a vacuum cleaner's negative pressured plenum chamber 1356, within the vacuum created by the vacuum cleaner, and thereby it will greatly reduce the noise level emitted by the motor.

The airflow patterns 1390, 1392 and 1394 are disclosed. Specifically, the suction air flow 1390 is sucked into the canister 1311 from the intake ports 1316 and 1314 and as is shown, goes through the filters 1346, 1348, and 1350 and around the air flow baffle plate 1386 and into the motor opening 1366 by the center impeller 1362 which helps cool the motor as well. The suction air 1390 becomes cooling air 1392 which goes through the motor for cooling the motor and substantially reducing the noise level generated by the motor 1360. The noise flow 1394 is then moved out of the canister 1311 through the motor exhaust horn 1364, the exhaust elbow 1354 and the exhaust tube 1358.

Figure 16:
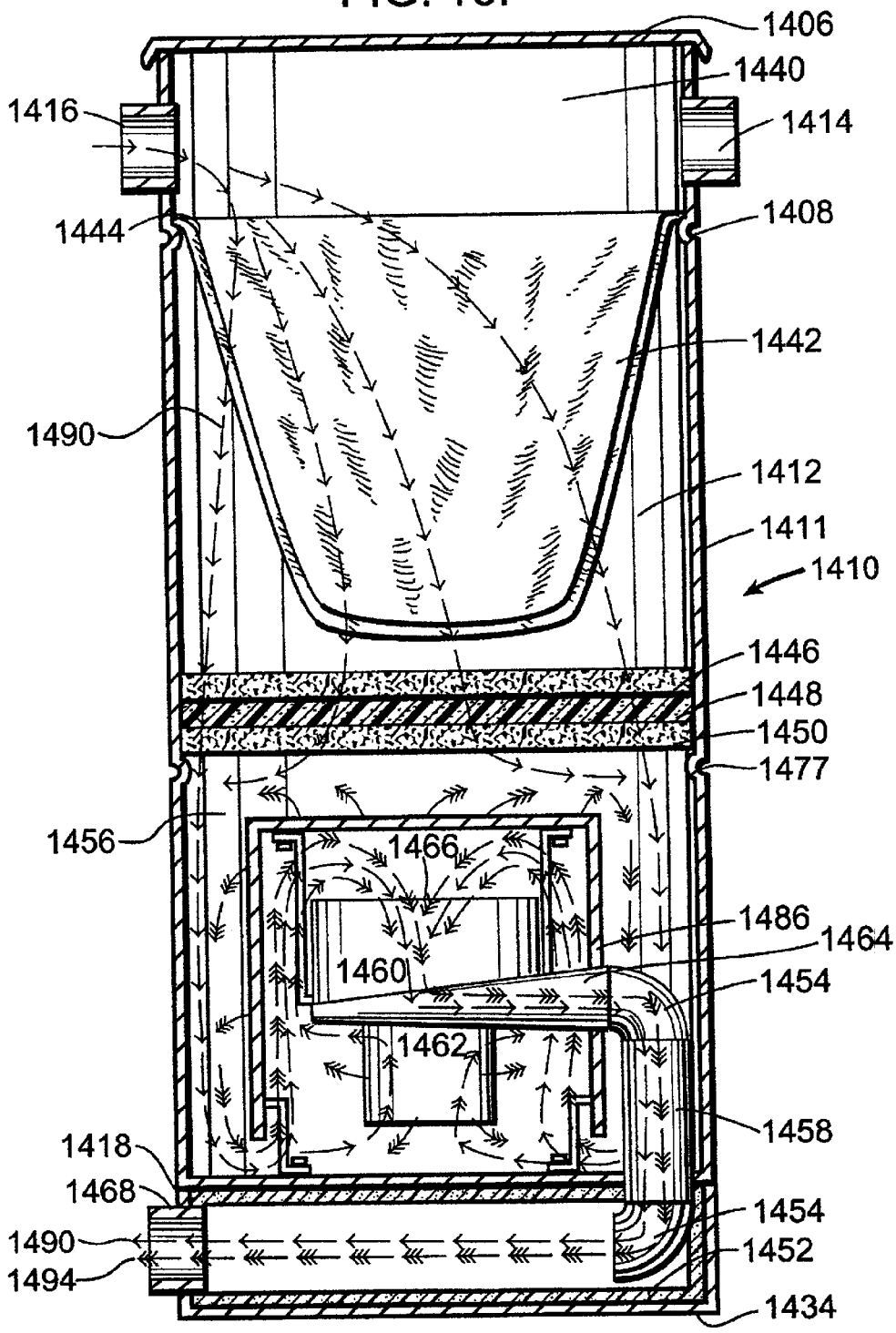
FIG. 16 is an enlarged longitudinal cross-sectional view looking from the front of the central vacuum cleaning system, illustrating a fourteenth arrangement of the improvements of the present invention therein.

Referring to FIG. 16, there is shown a fourteenth arrangement of the improvements of the present invention central vacuum cleaning system 1410. The canister 1411 comprises an upper interior hollow compartment 1440 and a lower interior hollow compartment 1456. The upper compartment 1440 houses within it a removable dirt and dust collection bag 1442. The collection bag 1442 has an upper rim 1444 which rests on an interior ledge 1408 of the interior wall of the canister 1411. Below the dirt and dust collection bag 1442 are a plurality of filters, which include a first mesh or coarse filter 1446, a fine or foam filter 1448 and a second mesh or coarse filter 1450. The first filter 1446 rests on top of the foam filter 1448 which in turn rests on top of the second filter 1450, which in turn all rest on a second interior ledge 1477.

As can be seen by the airflow arrows 1490 (with only one arrow head), suction created by an electrical motor 1460 causes a flow of suction air into the upper interior chamber 1440 of the canister 1411 and creates a suction which draws dirt, dust and other particulates into the collection bag 1442. Since the bag 1442 is porous to allow air flow through it, the filters 1446, 1448 and 1450 serve to trap any escaped dirt and dust so that it will not damage the motor 1460. The portion described so far are conventional components which are known in prior art central power and suction unit designs.

The present invention central vacuum cleaning system 1410 can operate with any plurality of motors within its design. At least one motor 1460 and armature 1462 is required for the central power and suction unit. Conventionally, either one, two or three motors can be used. In this fourteenth arrangement of the improvements of the present invention central vacuum cleaning system 1410 as illustrated, only one motor 1460 is used. The motor 1460 is housed in the second interior compartment 1456 as shown which lies below the upper interior hollow compartment 1440 and is separated from it by the filters. The motor 1460 is mounted on the lower side of an air flow baffle plate 1486 and spaced apart by an upper bracket 1438. The baffle plate 1486 surrounds the motor 1460 and the impeller 1462 and is mounted above and spaced apart from a lower base 1418 of the canister 1411 by a lower bracket 1436. The motor 1460 by way of example can be 120 volts, one and one-quarter (1¼) horsepower suction motor. There is provided a motor exhaust horn 1464 which extends into the lower interior compartment 1456. The motor exhaust horn 1464 is connected to an exhaust elbow 1454 which in turn is connected to an exhaust tube 1458 that extends out from the lower base 1418 of the canister 1411. The exhaust tube 1458 is further connected to another exhaust elbow 1454 which extends into an exhaust housing cover 1434 located outside of the canister 1411 adjacent to the lower base 1418. The exhaust housing cover 1434 is then connected to an exhaust port 1468 which extends to the exterior of the canister 1411. There is provided a soundproof material 1452 affixed to the interior surface of the exhaust housing cover 1434. As can be seen by the flow arrows 1490 and 1494, the exhaust tube 1458 is important to provide an exit for the airflow from the motor armature 1462 to escape from the canister 1411 and into the exhaust housing cover 1434 which in turn escapes to the outside of the canister by the exhaust port 1468. As represented by the arrows, the suction air 1490 is represented by an arrow having one arrow head, cooling air 1492 is represented by an arrow having two arrow heads, and noise flow 1494 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motor 1460 is housed. The electrical motor operates inside of a vacuum cleaner's negative pressured plenum chamber 1456, within the vacuum created by the vacuum cleaner, and thereby it will greatly reduce the noise level emitted by the motor.

The airflow patterns 1490, 1492 and 1494 are disclosed. Specifically, the suction air flow 1490 is sucked into the canister 1411 from the intake ports 1416 and 1414 and as is shown, goes through the filters 1446, 1448, and 1450 and around the air flow baffle plate 1486 and into the motor opening 1466 by the center impeller 1462 which helps cool the motor as well. The suction air 1490 becomes cooling air 1492 which goes through the motor for cooling the motor and substantially reducing the noise level generated by the motor 1460. The noise flow 1494 is then moved out of the canister 1411 through the exhaust housing cover 1434.

Figure 17:
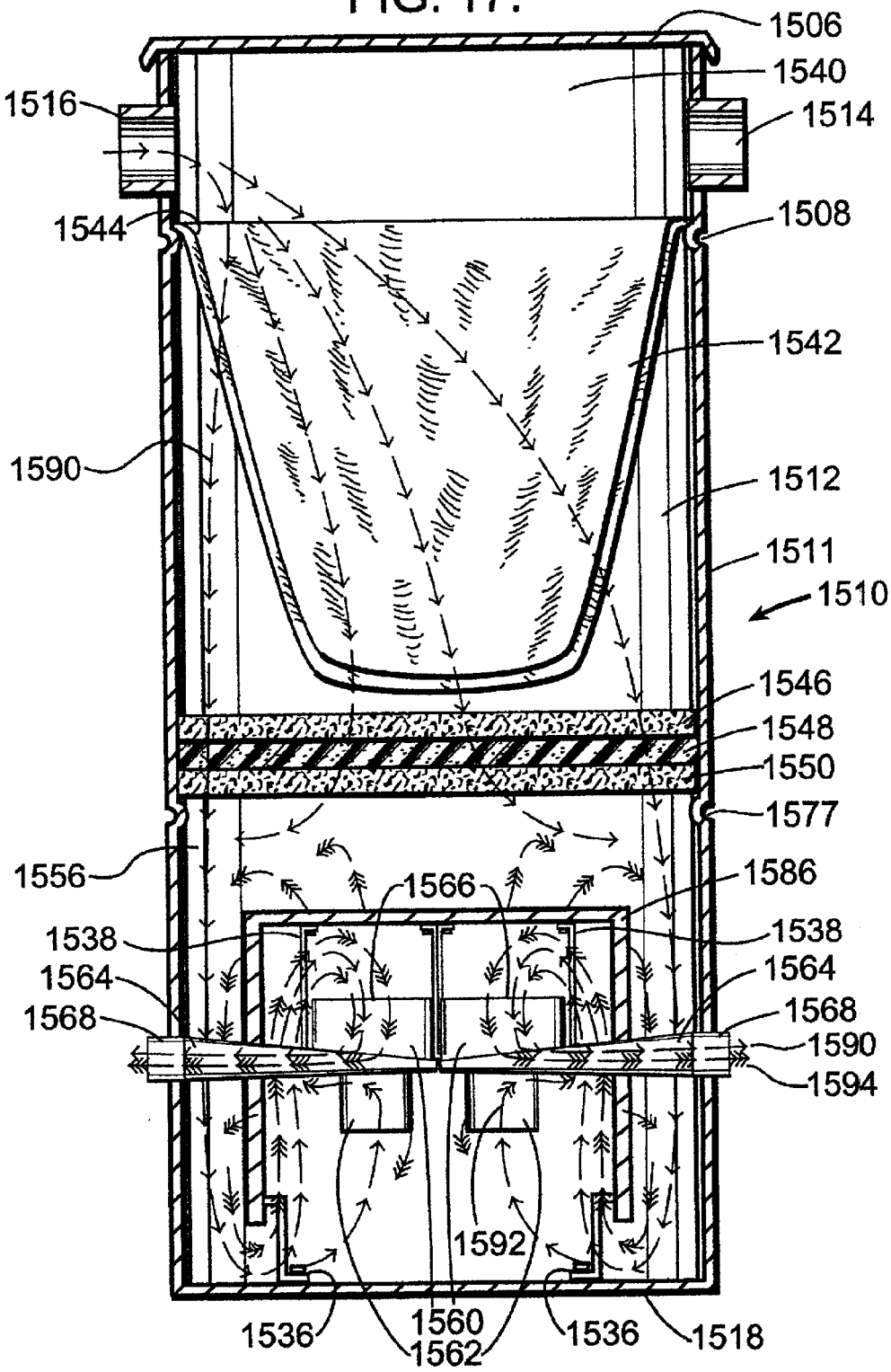
FIG. 17 is an enlarged longitudinal cross-sectional view looking from the front of the central vacuum cleaning system, illustrating a fifteenth arrangement of the improvements of the present invention therein.

Referring to FIG. 17, there is shown a fifteenth arrangement of the improvements of the present invention central vacuum cleaning system 1510. This fifteenth arrangement of the improvements of the present invention is very similar to the fifth arrangement shown and discussed in FIG. 7 and the only difference is the nature and configuration of at least two motors 1560 instead of one motor shown in FIG. 7. All of the parts of the fifteenth arrangement are correspondingly numbered in a 1500 series reference number rather than a 500 series reference number used in the fifth arrangement of the present invention.

The canister 1511 comprises an upper interior hollow compartment 1540 and a lower interior hollow compartment 1556. The upper compartment 1540 houses within it a removable dirt and dust collection bag 1542. The collection bag 1542 has an upper rim 1544 which rests on an interior ledge 1508 of the interior wall of the canister 1511. Below the dirt and dust collection bag 1542 are a plurality of filters, which include a first mesh or coarse filter 1546, a fine or foam filter 1548 and a second mesh or coarse filter 1550. The first filter 1546 rests on top of the foam filter 1548 which in turn rests on top of the second filter 1550, which in turn all rest on a second interior ledge 1577.

As can be seen by the air flow arrows 1590 (with only one arrow head), suction created by a pair of electrical motors 1560 causes a flow of suction air into the upper interior chamber 1540 of the canister 1511 and creates a suction which draws dirt, dust and other particulates into the collection bag 1542. Since the bag 1542 is porous to allow air flow through it, the filters 1546, 1548 and 1550 serve to trap any escaped dirt and dust so that it will not damage the motors 1560.

Each motor 1560 has an armature or impeller 1562 which is required for the central power and suction unit. The motors 1560 are housed in the lower interior compartment 1556 as shown which lies below the upper interior hollow compartment 1540 and is separated from it by the filters. The motors 1560 are mounted on the lower side of an air flow baffle plate 1586 and spaced apart by upper brackets 1538. The baffle plate 1586 surrounds the motors 1560 and the impellers 1562 and is mounted above and spaced apart from a lower base 1518 of the canister 1511 by lower brackets 1536. The motors 1560 by way of example can be 120 volts, one and one-quarter (1¼) horsepower suction motor. There are provided motor exhaust horns 1564 which extend into the lower interior compartment 1556 and extend out from the canister sidewall 1512 and connect to the exhaust ports 1568. As can be seen by the flow arrows 1590 and 1594, the exhaust ports 1568 are important to provide an exit for the air flow from the motor armatures 1562 to escape from the lower compartment 1556 of canister 1511. As represented by the arrows, the suction air 1590 is represented by an arrow having one arrow head, cooling air 1554 is represented by an arrow having two arrow heads, and noise flow 1594 is represented by an arrow having three arrow heads. It has been determined that the motor which ordinarily generates an exterior noise level in the range of 85 to 96 decibels are substantially reduced through inclusion of the present invention dampening means.

The unique portion of the present invention involves the lower portion where the motors 1560 are housed. The electrical motors operate inside of a vacuum cleaner's negative pressured plenum chamber 1556, within the vacuum created by the vacuum cleaner, and thereby it will greatly reduce the noise level emitted by the motors.

The air flow patterns 1590, 1592 and 1594 are disclosed. Specifically, the suction air flow 1590 is sucked into the canister 1511 from the intake ports 1516 and 1514 and as is shown, goes through the filters 1546, 1548 and 1550, and around the air flow baffle plate 1586 and into the center impellers 1562 which help cool the motors as well. The suction air 1590 becomes cooling air 1592 which goes around the motors and into the motor openings 1566 for cooling the motors and substantially reducing the noise level generated by the motors 1560. The noise flow 1594 is then moved out of the canister 1511 by the exhaust horns 1564 which are connected to the exhaust ports 1568.

Figure 18:
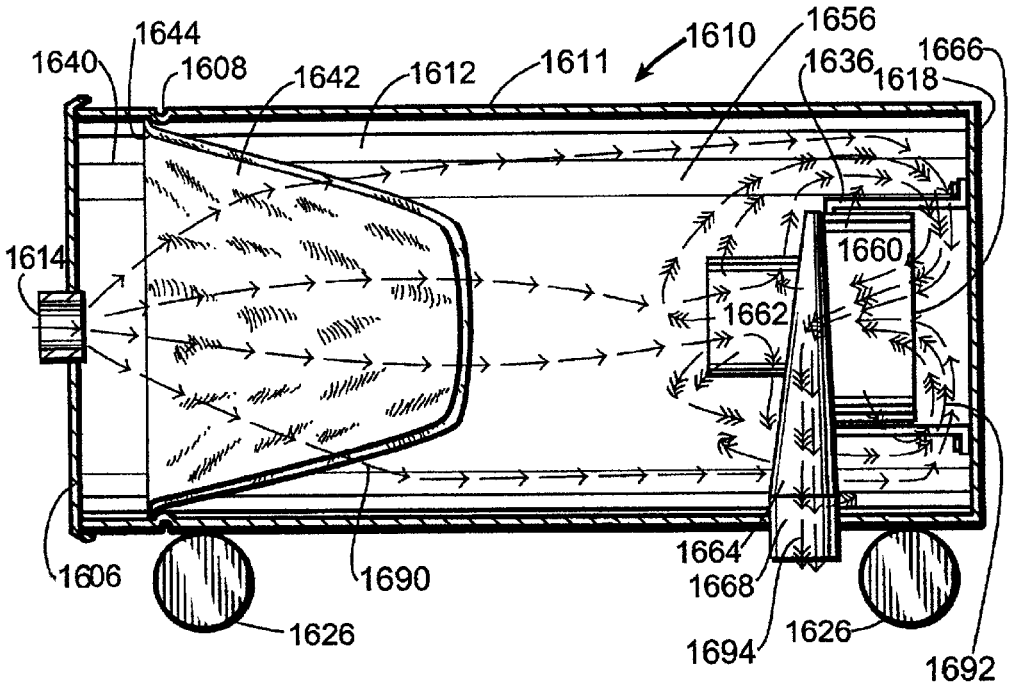
FIG. 18 is an enlarged longitudinal cross-sectional view of an alternative embodiment of the present invention portable vacuum cleaner, illustrating a first arrangement of the improvements therein.

Referring to FIG. 18, there is shown at 1610 an alternative embodiment of the present invention which is a portable vacuum cleaner illustrating a first arrangement of the improvements of the present invention. The vacuum cleaner 1610 comprises a canister 1611 which has a first interior hollow compartment 1640, a second interior hollow compartment 1656 and two opposite ends. There is further provided wheels 1626 for making the vacuum cleaner portable. The first compartment 1640 houses within it a removable dirt and dust collection bag 1642. The collection bag 1642 has an upper rim 1644 which rests on an interior ledge 1608 of the interior wall of the canister 1611.

As can be seen by the airflow arrows 1690 (with only one arrow head), suction created by an electrical motor 1660 causes a flow of suction air into the first interior compartment 1640 of the canister 1611 and creates a suction which draws dirt, dust and other particulates into the collection bag 1642. The bag 1642 is porous to allow air flow through it.

The present invention portable vacuum cleaner 1610 can operate with any plurality of motors within its design. At least one motor 1660 and armature 1662 is required for the suction unit. Conventionally, either one, two or three motors can be used. In this first arrangement of the improvements of the present invention portable vacuum cleaner 1610 as illustrated, only one motor 1660 is used. The motor 1660 is housed in the second interior compartment 1656 as shown which lies next to the first interior hollow compartment 1640. The motor 1660 is mounted above and spaced apart from a lower base 1618 of the canister 1611 by a bracket 1636. The motor 1660 by way of example can be 120 volts, one and one-quarter (1¼) horsepower suction motor. There is provided a motor exhaust horn 1664 which extends into the second interior compartment 1656 and extends out from the canister sidewall 1612 and connects to the exhaust port 1668. As can be seen by the flow arrows 1690 and 1694, the exhaust port 1668 is important to provide an exit for the air flow from the motor armature 1662 to escape from the canister 1611. As represented by the arrows, the suction air flow 1690 is represented by an arrow having one arrow head, cooling air flow 1692 is represented by an arrow having two arrow heads, and noise flow 1694 is represented by an arrow having three arrow heads.

The unique portion of the present invention involves the second compartment where the motor 1660 is housed. The electrical motor operates inside of a vacuum cleaner's negative pressured plenum chamber 1656, within the vacuum created by the vacuum cleaner, and thereby it will greatly reduce the noise level emitted by the motor.

The air flow patterns 1690, 1692 and 1694 are disclosed. Specifically, the suction air flow 1690 is sucked into the canister 1611 from the intake port 1614 and as is shown, goes into the motor armature 1662 which helps cool the motor as well. The suction air 1690 becomes cooling air 1692 which goes around the motor and into the motor opening 1666 for cooling the motor and substantially reducing the noise level generated by the motor 1660. The noise flow 1694 is moved out of the canister 1611 by the exhaust horn 1664 which is connected to the exhaust port 1668.

Figure 19:
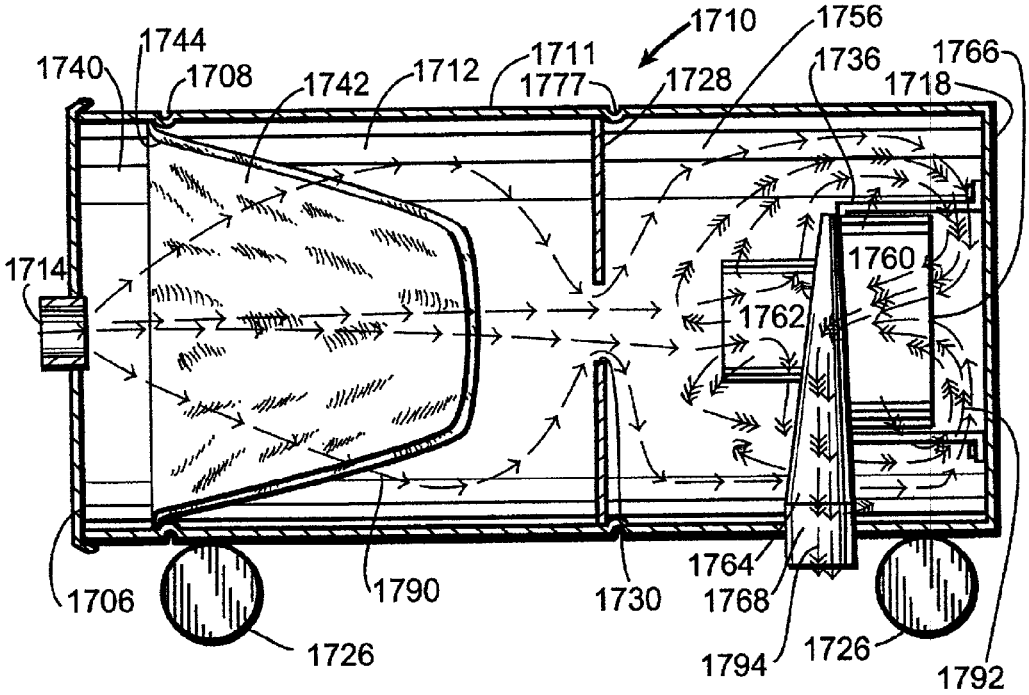
FIG. 19 is an enlarged longitudinal cross-sectional view of the alternative embodiment of the present invention portable vacuum cleaner, illustrating a second arrangement of the improvements therein.

Referring to FIG. 19, there is shown at 1710 the alternative embodiment of the present invention which is a portable vacuum cleaner illustrating a second arrangement of the improvements of the present invention. This second arrangement of the improvements of the present invention is very similar to the first arrangement just discussed above in FIG. 18 and the only difference is the nature and configuration of an air diffuser plate 1728 which separates the two compartments of the vacuum cleaner 1710. All of the parts of the second arrangement are correspondingly numbered in a 1700 series reference number rather than a 1600 series reference number used in the first arrangement of the present invention shown in FIG. 18. The canister 1711 comprises an first interior hollow compartment 1740, a second interior hollow compartment 1756, and an air diffuser plate 1728 which separates the first and second compartments 1740 and 1756. There is further provided wheels 1726 for making the vacuum cleaner portable. The first compartment 1740 houses within it a removable dirt and dust collection bag 1742. The collection bag 1742 has an upper rim 1744 which rests on an interior ledge 1708 of the interior wall of the canister 1711. The air diffuser plate 1728 rests on top of a second interior ledge 1777.

As can be seen by the suction air flow arrows 1790 (with only one arrow head), suction created by an electrical motor 1760 causes a flow of air into the first interior chamber 1740 of the canister 1711 and creates a suction which draws dirt, dust and other particulates into the collection bag 1742. The bag 1742 is porous to allow air flow through it.

The present invention portable vacuum cleaner 1710 can operate with any plurality of motors within its design. At least one motor 1760 and armature 1762 is required for the suction unit. Conventionally, either one, two or three motors can be used. In this second arrangement of the improvements of the present invention portable vacuum cleaner 1710 as illustrated, only one motor 1760 is used. The motor 1760 is housed in the second interior compartment 1756 as shown which lies next to the first interior hollow compartment 1740 and is separated from it by the air diffuser plate 1728. The motor 1760 is mounted above and spaced apart from a lower base 1718 of the canister 1711 by brackets 1736. The motor 1760 by way of example can be 120 volts, one and one-quarter (1¼) horsepower suction motor. There is provided a motor exhaust horn 1764 which extends into the second interior compartment 1756 and extends out from the canister sidewall 1712 and connects to the exhaust port 1768. As can be seen by the flow arrows 1790 and 1794, the exhaust port 1768 is important to provide an exit for the noise flow from the motor armature 1762 to escape from the canister 1711. As represented by the arrows, the suction air 1790 is represented by an arrow having one arrow head, cooling air 1792 is represented by an arrow having two arrow heads, and noise flow 1794 is represented by an arrow having three arrow heads.

The unique portion of the present invention involves the second compartment where the motor 1760 is housed. The electrical motor operates inside of a vacuum cleaner's negative pressured plenum chamber 1756, within the vacuum created by the vacuum cleaner, and thereby it will greatly reduce the noise level emitted by the motor.

The airflow patterns 1790, 1792 and 1794 are disclosed. Specifically, the suction air flow 1790 is sucked into the canister 1711 from the intake port 1714 and as is shown, goes through a central opening 1730 on the air diffuser plate 1728 and into the motor armature 1762 which helps cool the motor as well. The suction air 1790 becomes cooling air 1792 which goes around the motor and into the motor opening 1766 for cooling the motor and substantially reducing the noise level of the motor 1760. The noise flow 1794 is moved out of the second compartment 1756 of canister 1711 by the exhaust horn 1764 which is connected to the exhaust port 1768.

Figure 20:
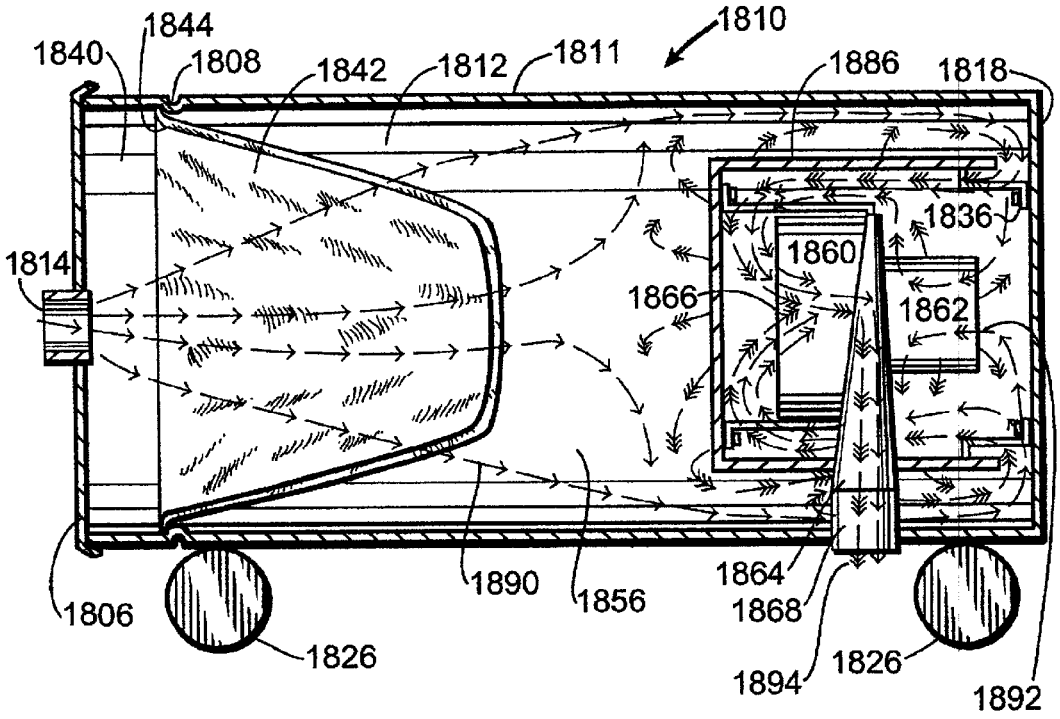
FIG. 20 is an enlarged longitudinal cross-sectional view of the alternative embodiment of the present invention portable vacuum cleaner, illustrating a third arrangement of the improvements therein.

Referring to FIG. 20, there is shown at 1810 the alternative embodiment of the present invention portable vacuum cleaner illustrating a third arrangement of the improvements of the present invention. The canister 1811 comprises an first interior hollow compartment 1840 and a second interior hollow compartment 1856. There is further provided wheels 1826 for making the vacuum cleaner portable. The first compartment 1840 houses within it a removable dirt and dust collection bag 1842. The collection bag 1842 has an upper rim 1844 which rests on an interior ledge 1808 of the interior wall of the canister 1811.

As can be seen by the air flow arrows 1890 (with only one arrow head), suction created by an electrical motor 1860 causes a flow of suction air into the first interior chamber 1840 of the canister 1811 and creates a suction which draws dirt, dust and other particulates into the collection bag 1842, where the bag 1842 is porous to allow air flow through it.

The present invention vacuum cleaner 1810 can operate with any plurality of motors within its design. At least one motor 1860 and armature 1862 is required for the suction unit. Conventionally, either one, two or three motors can be used. In this third arrangement of the improvements of the present invention vacuum cleaner 1810 as illustrated, only one motor 1860 is used. The motor 1860 is housed in the second interior compartment 1856 as shown which lies next to the first interior hollow compartment 1840. The motor 1860 is mounted on the lower side of an air flow baffle plate 1886 and spaced apart by upper brackets 1838. The baffle plate 1886 surrounds the motor 1860 and the armature 1862 and is mounted above and spaced apart from a lower base 1818 of the canister 1811 by lower brackets 1836. The motor 1860 by way of example can be 120 volts, one and one-quarter (1¼) horsepower suction motor. There is provided a motor exhaust horn 1864 which extends into the second interior compartment 1856 and extends out from the canister sidewall 1812 and connects to the exhaust port 1868. As can be seen by the flow arrows 1890 and 1894, the exhaust port 1868 is important to provide an exit for the air flow from the motor armature 1862 to escape from the canister 1811. As represented by the arrows, the suction air 1890 is represented by an arrow having one arrow head, cooling air 1892 is represented by an arrow having two arrow heads, and noise flow 1894 is represented by an arrow having three arrow heads.

The unique portion of the present invention involves the second compartment where the motor 1860 is housed. The electrical motor operates inside of a vacuum cleaner's negative pressured plenum chamber 1856, within the vacuum created by the vacuum cleaner, and thereby it will greatly reduce the noise level emitted by the motor.

The airflow patterns 1890, 1892 and 1894 are disclosed. Specifically, the suction airflow 1890 is sucked into the canister 1811 from the intake port 1814 and as is shown, goes around the air flow baffle plate 1886 and into the armature 1862 which helps cool the motor as well. The suction air 1890 becomes cooling air 1892 which goes around the motor and into the motor opening 1866 for cooling the motor and substantially reducing the noise level of the motor 1860. The noise flow 1894 is then moved out of the canister 1811 by the exhaust horn 1864 which is connected to the exhaust port 1868.

Figure 21:
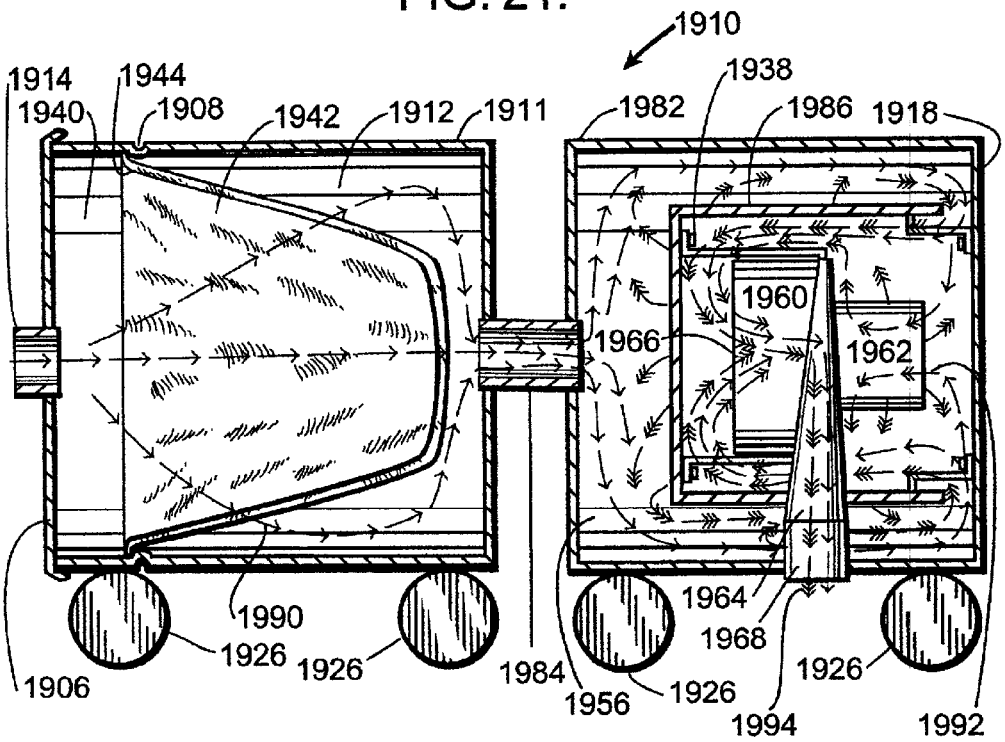
FIG. 21 is an enlarged longitudinal cross-sectional view of the alternative embodiment of the present invention portable vacuum cleaner, illustrating a fourth arrangement of the improvements therein.

Referring to FIG. 21, there is shown at 1910 the alternative embodiment of the present invention portable vacuum cleaner illustrating a fourth arrangement of the improvements of the present invention. This fourth arrangement of the improvements of the present invention is very similar to the third arrangement just discussed above in FIG. 20 and the only difference is the nature and configuration of two separate compartments of a canister. All of the parts of the fourth arrangement are correspondingly numbered in a 1900 series reference number rather than a 1800 series reference number used in the third arrangement of the present invention. The canister 1911 comprises a separate first interior hollow compartment 1940, a separate second interior hollow compartment 1956 and a pipe 1984 which connects the first and second compartments together. There are further provided wheels 1926 for making the vacuum cleaner portable. The first compartment 1940 houses within it a removable dirt and dust collection bag 1942. The collection bag 1942 has an upper rim 1944 which rests on an interior ledge 1908 of the interior wall of the canister 1911.

As can be seen by the suction air flow arrows 1990 (with only one arrow head), suction created by an electrical motor 1960 causes a flow of air into the first interior compartment 1940 of the canister 1911 and creates a suction which draws dirt, dust and other particulates into the collection bag 1942, where the bag 1942 is porous to allow air flow through it.

The present invention vacuum cleaner 1910 can operate with any plurality of motors within its design. At least one motor 1960 and armature 1962 is required for the suction unit. Conventionally, either one, two or three motors can be used. In this fourth arrangement of the improvements of the present invention vacuum cleaner 1910 as illustrated, only one motor 1960 is used. The motor 1960 is housed in the second interior compartment 1956 as shown which lies next to the first interior compartment 1940. The motor 1960 is mounted on the lower side of an air flow baffle plate 1986 and spaced apart therefrom by upper brackets 1938. The baffle plate 1986 surrounds the motor 1960 and the armature 1962 and is mounted above and spaced apart from a lower base 1918 of the second compartment 1956 by lower brackets 1936. The motor 1960 by way of example can be 120 volts, one and one-quarter (1¼) horsepower suction motor. There is provided a motor exhaust horn 1964 which extends into the second interior compartment 1956 and extends out from the lower canister sidewall 1982 and connects to the exhaust port 1968. As can be seen by the flow arrows 1990 and 1994, the exhaust port 1968 is important to provide an exit for the noise flow from the motor armature 1962 to escape from the second compartment 1956. As represented by the arrows, the suction air 1990 is represented by an arrow having one arrow head, cooling air 1992 is represented by an arrow having two arrow heads, and noise flow 1994 is represented by an arrow having three arrow heads.

The unique portion of the present invention involves the second compartment where the motor 1960 is housed. The electrical motor operates inside of a vacuum cleaner's negative pressured plenum chamber 1956, within the vacuum created by the vacuum cleaner, and thereby it will greatly reduce the noise level emitted by the motor.

The air flow patterns 1990, 1992 and 1994 are disclosed. Specifically, the suction air flow 1990 is sucked into the canister 1911 from the intake port 1914 and as is shown, goes through the pipe 1984 and around the baffle plate 1986 and into the armature 1962 which helps cool the motor as well. The suction air 1990 becomes cooling air 1992 which goes around the motor and into the motor opening 1966 for cooling the motor and substantially reducing the noise level of the motor 1960. The noise flow 1994 is moved out of the second compartment 1956 by the exhaust horn 1964 which is connected to the exhaust port 1968.

Figure 22:
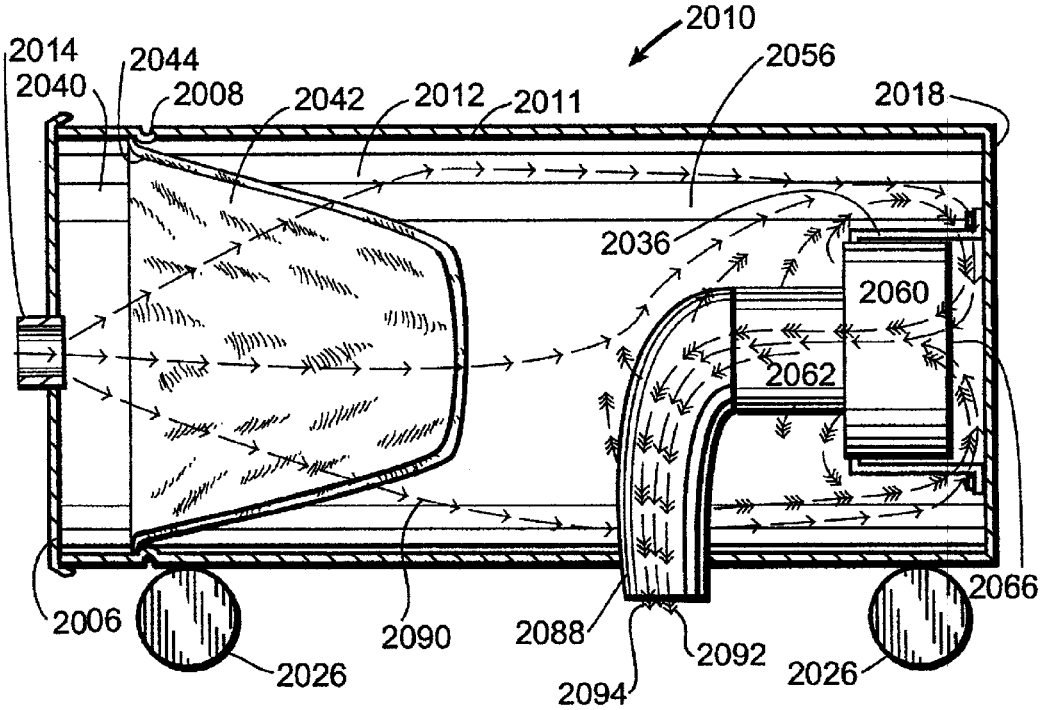
FIG. 22 is an enlarged longitudinal cross-sectional view of the alternative embodiment of the present invention portable vacuum cleaner, illustrating a fifth arrangement of the improvements therein.

Referring to FIG. 22, there is shown at 2010 the alternative embodiment of the present invention portable vacuum cleaner illustrating a fifth arrangement of the improvements of the present invention. The canister 2011 comprises a first interior hollow compartment 2040 and a second interior hollow compartment 2056. There are provided wheels 2026 for making the vacuum cleaner portable. The first compartment 2040 houses within it a removable dirt and dust collection bag 2042. The collection bag 2042 has an upper rim 2044 which rests on an interior ledge 2008 of the interior wall of the canister 2011.

As can be seen by the airflow arrows 2090 (with only one arrow head), suction created by an electrical motor 2060 causes a flow of suction air into the first interior compartment 2040 of the canister 2011 and creates a suction which draws dirt, dust and other particulates into the collection bag 2042, where the bag 2042 is porous to allow air flow through it.

The present invention vacuum cleaner 2010 can operate with any plurality of motors within its design. At least one motor 2060 and armature 2062 is required for the suction unit. Conventionally, either one, two or three motors can be used. In this seventh arrangement of the improvements of the present invention vacuum cleaner 2010 as illustrated, only one motor 2060 is used. The motor 2060 is housed in the second interior compartment 2056 as shown which lies next to the first interior compartment 2040. The motor 2060 is mounted above and spaced apart from a lower base 2018 of the canister 2011 by brackets 2036. The motor 2060 by way of example can be 120 volts, one and one-quarter (1¼) horsepower suction motor. There is provided a cooling exhaust pipe 2088 which extends into the second interior compartment 2056 and covering the motor armature 2062. The cooling exhaust pipe 2088 further extends out from the canister sidewall 2012. As can be seen by the flow arrows 2090, 2092 and 2094, the cooling exhaust pipe 2088 is important to provide an exit for the airflow from the motor armature 2062 to escape from the canister 2011. As represented by the arrows, the suction air flow 2090 is represented by an arrow having one arrow head, cooling air flow 2092 is represented by an arrow having two arrow heads, and noise flow 2094 is represented by an arrow having three arrow heads.

The unique portion of the present invention involves the second compartment where the motor 2060 is housed. The electrical motor operates inside of a vacuum cleaner's negative pressured plenum chamber 2056 within the vacuum created by the vacuum cleaner, and thereby, it will greatly reduce the noise level emitted by the motor.

The airflow patterns 2090, 2092 and 2094 are disclosed. Specifically, the suction air flow 2090 is sucked into the canister 2011 from the intake port 2014. The suction air 2090 becomes cooling air 2092 which goes around the motor and into the motor opening 2066 for cooling the motor and substantially reducing the noise level of the motor 2060. The suction air 2090, cooling air 2092 and noise flow 2094 are moved out of the canister 2011 by the cooling exhaust pipe 2088.

Figure 23:
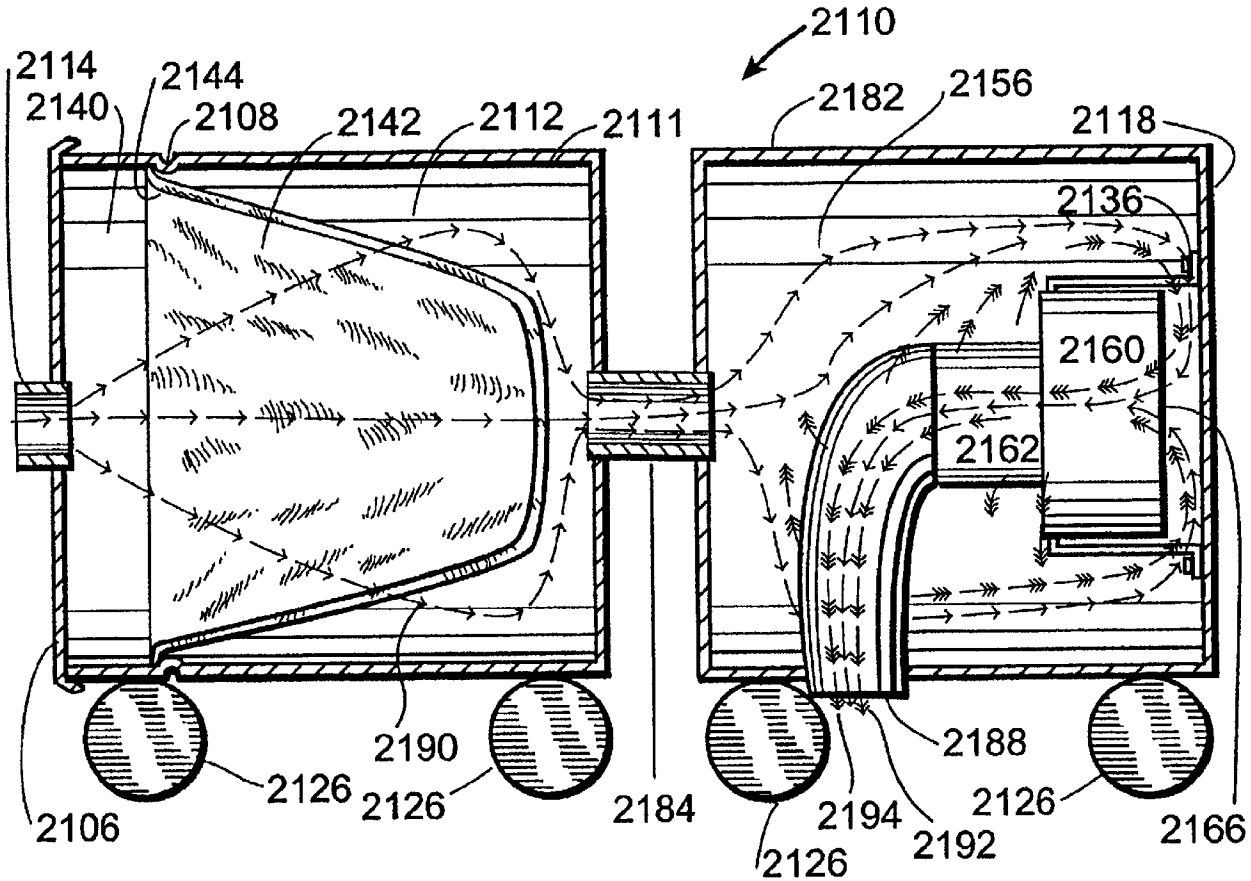
FIG. 23 is an enlarged longitudinal cross-sectional view of the alternative embodiment of the present invention portable vacuum cleaner, illustrating a sixth arrangement of the improvements therein.

Referring to FIG. 23, there is shown at 2110 the alternative embodiment of the present invention portable vacuum cleaner illustrating a sixth arrangement of the improvements of the present invention. The canister 2111 comprises a separate first interior hollow compartment 2140, a separate second interior hollow compartment 2156 and a pipe 2184 which connects the first and second compartments together. There are provided wheels 2126 for making the vacuum cleaner portable. The first compartment 2140 houses within it a removable dirt and dust collection bag 2142. The collection bag 2142 has an upper rim 2144 which rests on an interior ledge 2108 of the interior wall of the canister 2111.

As can be seen by the air flow arrows 2190 (with only one arrow head), suction created by an electrical motor 2160 causes a flow of suction air into the first interior compartment 2140 of the canister 2111 and creates a suction which draws dirt, dust and other particulates into the collection bag 2142, where the bag 2142 is porous to allow air flow through it.

The present invention vacuum cleaner 2110 can operate with any plurality of motors within its design. At least one motor 2160 and armature 2162 is required for the suction unit. Conventionally, either one, two or three motors can be used. In this sixth arrangement of the improvements of the present invention vacuum cleaner 2110 as illustrated, only one motor 2160 is used. The motor 2160 is housed in the second interior compartment 2156 as shown which lies next to the first interior hollow compartment 2140. The motor 2160 is mounted above and spaced apart from a lower base 2118 of the second compartment 2156 by brackets 2136. The motor 2160 by way of example can be 120 volts, one and one-quarter (1¼) horsepower suction motor. There is provided a cooling exhaust pipe 2188 which extends into the second interior compartment 2156 and covering the motor armature 2162. The cooling exhaust pipe 2188 further extends out from the lower canister sidewall 2182. As can be seen by the flow arrows 2190, 2192 and 2194, the cooling exhaust pipe 2188 is important to provide an exit for the air flow from the motor armature 2162 to escape from the second compartment 2156. As represented by the arrows, the suction air 2190 is represented by an arrow having one arrow head, cooling air 2192 is represented by an arrow having two arrow heads, and noise flow 2194 is represented by an arrow having three arrow heads.

The unique portion of the present invention involves the second compartment where the motor 2160 is housed. The electrical motor operates inside of a vacuum cleaner's negative pressured plenum chamber 2156 within the vacuum created by the vacuum cleaner, and thereby, it will greatly reduce the noise level emitted by the motor.

The airflow patterns 2190,2192 and 2194 are disclosed. Specifically, the suction air flow 2190 is sucked into the canister 2111 from the intake port 2114 and through the pipe 2184. The suction air 2190 becomes cooling air 2192 which goes around the motor and into the motor opening 2166 for cooling the motor and substantially reducing the noise level of the motor 2160. The suction air 2190, cooling air 2192 and noise flow 2194 are moved out of the second compartment 2156 by the cooling exhaust pipe 2188.

Figure 24:
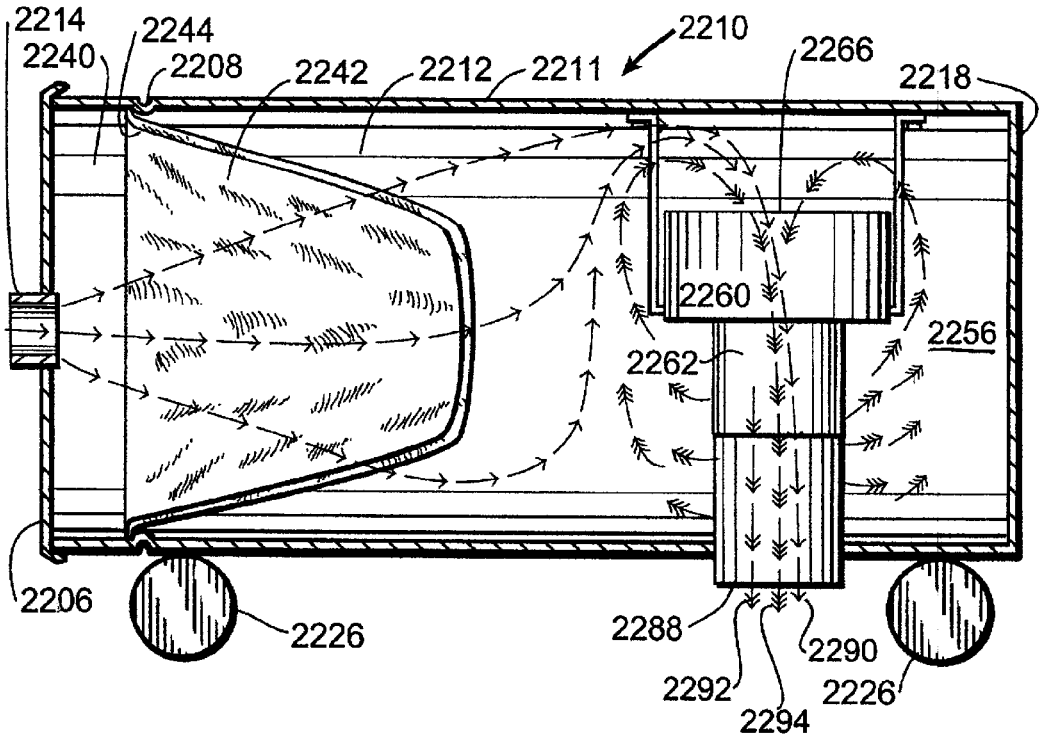
FIG. 24 is an enlarged longitudinal cross-sectional view of the alternative embodiment of the present invention portable vacuum cleaner, illustrating a seventh arrangement of the improvements therein.

Referring to FIG. 24, there is shown at 2210 the alternative embodiment of the present invention portable vacuum cleaner illustrating a seventh arrangement of the improvements of the present invention. The canister 2211 comprises a first interior hollow compartment 2240 and a second interior hollow compartment 2256. There are further provided wheels 2226 for making the vacuum cleaner portable. The first compartment 2240 houses within it a removable dirt and dust collection bag 2242. The collection bag 2242 has an upper rim 2244 which rests on an interior ledge 2208 of the interior wall of the canister 2211.

As can be seen by the air flow arrows 2290 (with only one arrow head), suction created by an electrical motor 2260 causes a flow of suction air into the first interior compartment 2240 of the canister 2211 and creates a suction which draws dirt, dust and other particulates into the collection bag 2242, where the bag 2242 is porous to allow air flow through it.

The present invention vacuum cleaner 2210 can operate with any plurality of motors within its design. At least one motor 2260 and armature 2262 is required for the suction unit. Conventionally, either one, two or three motors can be used. In this seventh arrangement of the improvements of the present invention vacuum cleaner 2210 as illustrated, only one motor 2260 is used. The motor 2260 is housed in the second interior compartment 2256 as shown which lies next to the first interior compartment 2240. The motor 2260 is mounted spaced apart from the sidewall 2212 of the canister 2211 by brackets 2236. The motor 2260 by way of example can be 120 volts, one and one-quarter (1¼) horsepower suction motor. There is provided a cooling exhaust pipe 2288 which has one end extending out from the sidewall 2212 of the canister 2211 and the other end covering the armature 2262 of the motor 2260. As can be seen by the flow arrows 2290, 2292 and 2294, the cooling exhaust pipe 2288 is important to provide an exit for the air flow from the motor armature 2262 to escape from the canister 2211. As represented by the arrows, the suction air 2290 is represented by an arrow having one arrow head, cooling air 2292 is represented by an arrow having two arrow heads, and noise flow 2294 is represented by an arrow having three arrow heads.

The unique portion of the present invention involves the second compartment where the motor 2260 is housed. The electrical motor operates inside of a vacuum cleaner's negative pressured plenum chamber 2256 within the vacuum created by the vacuum cleaner, and thereby, it will greatly reduce the noise level emitted by the motor.

The air flow patterns 2290, 2292 and 2294 are disclosed. Specifically, the suction air flow 2290 is sucked into the canister 2211 from the intake port 2214 and as is shown, goes into the motor opening 2266 by the armature 2262 which helps cool the motor as well. The suction air 2290 becomes cooling air 2292 which goes around the motor for cooling the motor and substantially reducing the noise level generated by the motor 2260. The suction air flow 2290, cooling air flow 2292 and noise flow 2294 are moved out of the canister 2211 via of the cooling exhaust pipe 2288.

Figure 25:
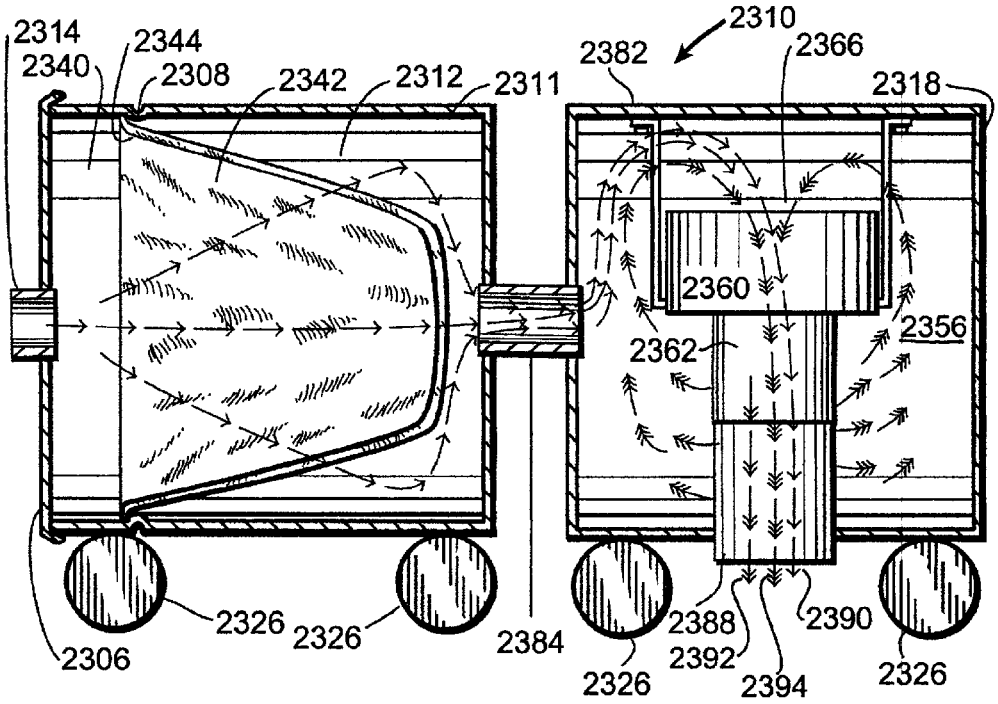
FIG. 25 is an enlarged longitudinal cross-sectional view of the alternative embodiment of the present invention portable vacuum cleaner, illustrating an eighth arrangement of the improvements therein.

Referring to FIG. 25, there is shown at 2310 the alternative embodiment of the present invention portable vacuum cleaner illustrating an eighth arrangement of the improvements of the present invention. The canister 2311 comprises a separate first interior hollow compartment 2340, a separate second interior hollow compartment 2356 and a pipe 2384 which connects the first and second compartments together. There are provided wheels 2326 for making the vacuum cleaner portable. The first compartment 2340 houses within it a removable dirt and dust collection bag 2342. The collection bag 2342 has an upper rim 2344 which rests on an interior ledge 2308 of the interior wall of the canister 2311.

As can be seen by the air flow arrows 2390 (with only one arrow head), suction created by an electrical motor 2360 causes a flow of suction air into the upper interior chamber 2340 of the canister 2311 and creates a suction which draws dirt, dust and other particulates into the collection bag 2342, where the bag 2342 is porous to allow airflow through it.

The present invention vacuum cleaner 2310 can operate with any plurality of motors within its design. At least one motor 2360 and armature 2362 is required for the suction unit. Conventionally, either one, two or three motors can be used. In this eighth arrangement of the improvements of the present invention vacuum cleaner 2310 as illustrated, only one motor 2360 is used. The motor 2360 is housed in the second interior compartment 2356 as shown which lies next to the first interior compartment 2340. The motor 2360 is mounted spaced apart from the lower canister sidewall 2382 by brackets 2336. The motor 2360 by way of example can be 120 volts, one and one-quarter (1¼) horsepower suction motor. There is provided a cooling exhaust pipe 2388 which has one end extending out from the sidewall 2382 and the other end covering the armature 2362 of the motor 2360. As can be seen by the flow arrows 2390, 2392 and 2394, the cooling exhaust pipe 2388 is important to provide an exit for the air flow from the motor armature 2362 to escape from the second compartment 2356. As represented by the arrows, the suction air 2390 is represented by an arrow having one arrow head, cooling air 2392 is represented by an arrow having two arrow heads, and noise flow 2394 is represented by an arrow having three arrow heads.

The unique portion of the present invention involves the second compartment where the motor 2360 is housed. The electrical motor operates inside of a vacuum cleaner's negative pressured plenum chamber 2356 within the vacuum created by the vacuum cleaner, and thereby, it will greatly reduce the noise level emitted by the motor.

The airflow patterns 2390, 2392 and 2394 are disclosed. Specifically, the suction air flow 2390 is sucked into the canister 2311 from the intake port 2314 and as is shown, goes through the pipe 2384 and into the motor opening 2366 by the armature 2362 which helps cool the motor as well. The suction air 2390 becomes cooling air 2392 which goes around the motor for cooling the motor and substantially reducing the noise level generated by the motor 2360. The suction air flow 2390, cooling air flow 2392 and noise flow 2394 are moved out of the second compartment 2356 via of the cooling exhaust pipe 2388.

Figure 26:
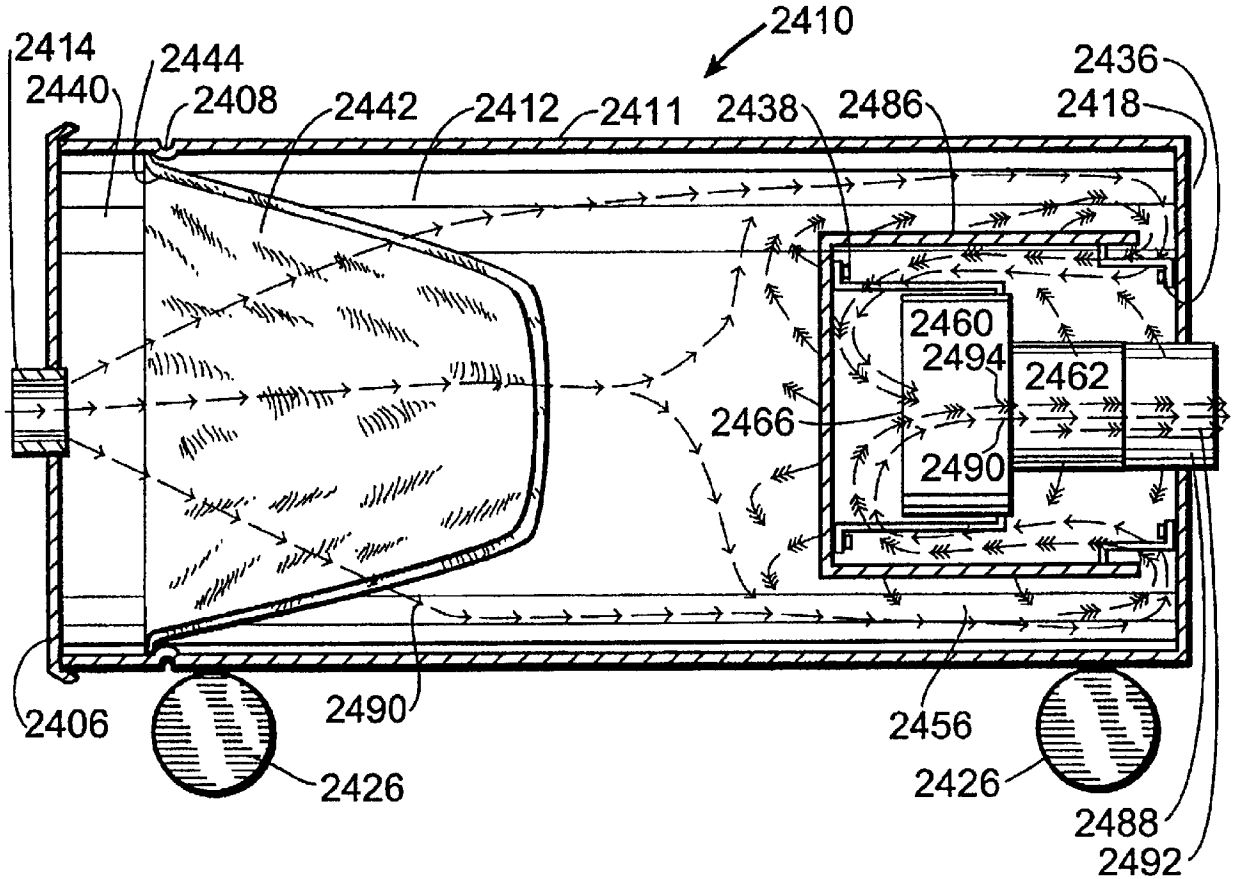
FIG. 26 is an enlarged longitudinal cross-sectional view of the alternative embodiment of the present invention portable vacuum cleaner, illustrating a ninth arrangement of the improvements therein.

Referring to FIG. 26, there is shown at 2410 the alternative embodiment of the present invention portable vacuum cleaner illustrating a ninth arrangement of the improvements of the present invention. The canister 2411 comprises a first interior hollow compartment 2440 and a second interior hollow compartment 2456. There are provided wheels 2426 for making the vacuum cleaner portable. The first compartment 2440 houses within it a removable dirt and dust collection bag 2442. The collection bag 2442 has an upper rim 2444 which rests on an interior ledge 2408 of the interior wall of the canister 2411.

As can be seen by the air flow arrows 2490 (with only one arrow head), suction created by an electrical motor 2460 causes a flow of suction air into the upper interior chamber 2440 of the canister 2411 and creates a suction which draws dirt, dust and other particulates into the collection bag 2442, where the bag 2442 is porous to allow air flow through it.

The present invention vacuum cleaner 2410 can operate with any plurality of motors within its design. At least one motor 2460 and armature 2462 is required for the suction unit. Conventionally, either one, two or three motors can be used. In this ninth arrangement of the improvements of the present invention vacuum cleaner 2410 as illustrated, only one motor 2460 is used. The motor 2460 is housed in the second interior compartment 2456 as shown which lies next to the first interior compartment 2440. The motor 2460 is mounted on the lower side of an air flow baffle plate 2486 and spaced apart by upper brackets 2438. The baffle plate 2486 surrounds the motor 2460 and the armature 2462 and is mounted above and spaced apart from a lower base 2418 of the canister 2411 by lower brackets 2436. The motor 2460 by way of example can be 120 volts, one and one-quarter (1¼) horsepower suction motor. There is provided a cooling exhaust pipe 2488 which has one end extending out from the lower base 2418 of the canister 2411 and the other end covering the armature 2462 of the motor 2460. As can be seen by the flow arrows 2490, 2492 and 2494, the cooling exhaust pipe 2488 is important to provide an exit for the air flow from the motor armature 2462 to escape from the canister 2411. As represented by the arrows, the suction air 2490 is represented by an arrow having one arrow head, cooling air 2492 is represented by an arrow having two arrow heads, and noise flow 2494 is represented by an arrow having three arrow heads.

The unique portion of the present invention involves the second compartment where the motor 2460 is housed. The electrical motor operates inside of a vacuum cleaner's negative pressured plenum chamber 2456 within the vacuum created by the vacuum cleaner, and thereby, it will greatly reduce the noise level emitted by the motor.

The air flow patterns 2490, 2492 and 2494 are disclosed. Specifically, the suction air flow 2490 is sucked into the canister 2411 from the intake port 2414 and as is shown, goes around the air flow baffle plate 2486 and into the motor opening 2466 by the armature 2462 which helps cool the motor as well. The suction air 2490 becomes cooling air 2492 which goes through the motor for cooling the motor and substantially reducing the noise level generated by the motor 2460. The suction air flow 2490, cooling air flow 2492 and noise flow 2494 are then moved out of the canister 2411 by the cooling exhaust pipe 2488.

Figure 27:
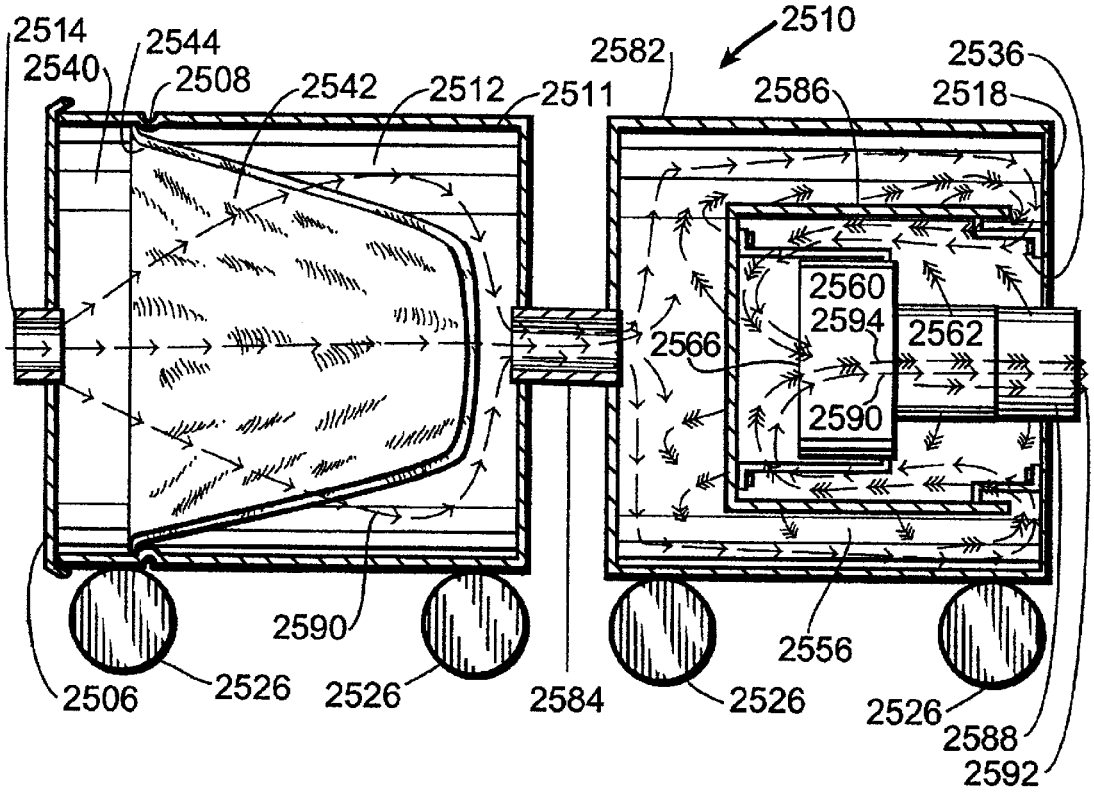
FIG. 27 is an enlarged longitudinal cross-sectional view of the alternative embodiment of the present invention portable vacuum cleaner, illustrating a tenth arrangement of the improvements therein.

Referring to FIG. 27, there is shown at 2510 the alternative embodiment of the present invention portable vacuum cleaner illustrating a tenth arrangement of the improvements of the present invention. The canister 2511 comprises a separate first interior hollow compartment 2540, a separate second interior hollow compartment 2556 and a pipe 2580 which connects the first and second compartments together. The first compartment 2540 houses within it a removable dirt and dust collection bag 2542. The collection bag 2542 has an upper rim 2544 which rests on an interior ledge 2508 of the interior wall of the canister 2511.

As can be seen by the air flow arrows 2590 (with only one arrow head), suction created by an electrical motor 2560 causes a flow of suction air into the first interior compartment 2540 of the canister 2511 and creates a suction which draws dirt, dust and other particulates into the collection bag 2542, where the bag 2542 is porous to allow air flow through it.

The present invention vacuum cleaner 2510 can operate with any plurality of motors within its design. At least one motor 2560 and armature 2562 is required for the suction unit. Conventionally, either one, two or three motors can be used. In this tenth arrangement of the improvements of the present invention vacuum cleaner 2510 as illustrated, only one motor 2560 is used. The motor 2560 is housed in the second interior compartment 2556 as shown which lies next to the first interior compartment 2540. The motor 2560 is mounted on the lower side of an air flow baffle plate 2586 and spaced apart by upper brackets 2538. The baffle plate 2586 surrounds the motor 2560 and the armature 2562 and is mounted above and spaced apart from a lower base 2518 by lower brackets 2536. The motor 2560 by way of example can be 120 volts, one and one-quarter (1¼) horsepower suction motor. There is provided a cooling exhaust pipe 2588 which has one end extending out from the lower base 2518 of the second compartment 2556 of canister 2511 and the other end covering the armature 2562 of the motor 2560. As can be seen by the flow arrows 2590, 2592 and 2594, the cooling exhaust pipe 2588 is important to provide an exit for the air flow from the motor armature 2562 to escape from the second compartment 2556 of canister 2511. As represented by the arrows, the suction air 2590 is represented by an arrow having one arrow head, cooling air 2592 is represented by an arrow having two arrow heads, and noise flow 2594 is represented by an arrow having three arrow heads.

The unique portion of the present invention involves the second compartment where the motor 2560 is housed. The electrical motor operates inside of a vacuum cleaner's negative pressured plenum chamber 2556 within the vacuum created by the vacuum cleaner, and thereby, it will greatly reduce the noise level emitted by the motor.

The air flow patterns 2590, 2592 and 2594 are disclosed. Specifically, the suction air flow 2590 is sucked into the canister 2511 from the intake port 2514 and as is shown, goes through the pipe 2584 and around the air flow baffle plate 2586 and into the motor opening 2566 by the armature 2562 which helps cool the motor as well. The suction air 2590 becomes cooling air 2592 which goes through the motor for cooling the motor and substantially reducing the noise level generated by the motor 2560. The suction air flow 2590, cooling air flow 2592 and noise flow 2594 are then moved out of the second compartment 2556 by the cooling exhaust pipe 2588.

Defined in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) bracket means mounting the at least one motor into the lower interior compartment which forms a negative pressured plenum chamber, where the at least one motor is spaced apart from the bottom such that the armature is extending upwardly therefrom for permitting suction air to enter thereto; (b) exhaust means in the sidewall to permit hot air exhaust and noise flow from the at least one motor to exit the negative pressured plenum chamber, (c) a motor exhaust horn extending into the negative pressured plenum chamber and connected to the exhaust means; (d) air intake means in the sidewall to permit the suction air to enter the canister; and (e) the suction air flows into the upper compartment and into the negative pressured plenum chamber, where the suction air becomes cooling air and noise flow which in turn flow around the at least one motor and into a motor opening located adjacent to the bottom of the canister and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum chamber reduces the noise level emitted from the at least one motor while at the same time cooling the at least one motor.

Defined also in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) bracket means mounting the at least one motor into the lower interior compartment which forms a negative pressured plenum chamber, where the at least one motor is spaced apart from the bottom such that the armature is extending upwardly therefrom for permitting suction air to enter thereto; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) an air diffuser plate affixed to the sidewall and separating the upper compartment with the lower compartment, the air diffuser having an opening therethrough; (e) air intake means in the sidewall to permit the suction air to enter the canister; and (f) the suction air flows into the upper compartment through the air intake means which in turn flows through the opening of the diffuser plate which in turn is sucked into the armature, which becomes cooling air and noise flow which flow around the at least one motor and into a motor opening located adjacent to the bottom of the negative pressured plenum chamber and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (g) whereby the negative pressured plenum compartment reduces the noise level emitted from the at least one motor while at the same time cooling the at least one motor.

Defined alternatively in detail, the present invention is an improved power unit for a vacuum cleaner including a canister having a sidewall, a top and a bottom, an upper interior hollow compartment housing a removable dirt and dust collection receptacle, a lower interior hollow compartment which houses at least one motor and armature, and a joint connecting the upper compartment with the lower compartment, with the at least one motor emitting noise when the at least one motor is turned on, the improvement comprising: (a) bracket means mounting the at least one motor into the lower interior compartment which forms a negative pressured plenum chamber and spaced apart from a bottom of the negative chamber such that the armature is extending upwardly therefrom for permitting suction air to enter thereto; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) air intake means in the sidewall to permit the suction air to enter the canister; and (e) the suction air flows into the upper compartment which in turn is sucked into the armature through the joint, where the suction air becomes cooling air and noise flow which flows around the at least one motor and into a motor opening located adjacent to the bottom of the negative pressured plenum chamber and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum chamber reduces the noise level emitted from the at least one motor while at the same time cooling the at least one motor.

Defined also alternatively in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) an air flow baffle plate mounted within the lower interior compartment which forms a negative pressured plenum chamber and spaced apart from the bottom such that the armature is extending downwardly therefrom for permitting suction air to enter thereto, the baffle plate surrounding the at least one motor and the armature, such that the at least one motor is mounted and spaced apart from a lower side of the baffle plate; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) air intake means in the sidewall to permit the suction air to enter the canister; and (e) the suction air flows into the upper compartment through the air intake means which in turn flows around the baffle plate and is sucked into the armature, where the suction air becomes cooling air and noise flow which flow around the at least one motor and into a motor opening located adjacent to the lower side of the baffle plate and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum chamber reduces the noise level emitted from the at least one motor while at the same time cooling the at least one motor.

Defined again alternatively in detail, the present invention is an improved power unit for a vacuum cleaner including a canister having a sidewall, a top and a bottom, an upper interior hollow compartment housing a removable dirt and dust collection receptacle, a lower interior hollow compartment which houses at least one motor and armature, and a pipe connecting the upper and lower compartments together, with the at least one motor emitting noise when the at least one motor is turned on, the improvement comprising: (a) an air flow baffle plate mounted within the lower interior compartment which forms a negative pressured plenum chamber and spaced apart the bottom such that the armature is extending downwardly therefrom for permitting suction air to enter thereto, the baffle plate surrounding the at least one motor and the armature, such that the at least one motor is mounted and spaced apart from a lower side of the baffle plate; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) air intake means in the sidewall to permit the suction air to enter the canister; and (e) the suction air flows into the upper compartment which in turn flows through the pipe and around the baffle plate and is sucked into the armature, where the suction air becomes cooling air and noise flow which flow around the at least one motor and into a motor opening located adjacent to the lower side of the baffle plate and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum compartment reduces the noise level emitted from the at least one motor while at the same time cooling the at least one motor.

Defined further alternatively in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) bracket means for mounting the at least one motor into the lower interior compartment which forms a negative pressured plenum chamber and spaced apart from the bottom such that the armature is extending upwardly therefrom; (b) a cooling exhaust pipe in the sidewall to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment and sucked into a motor opening located adjacent to the bottom by the armature, the suction air becomes cooling air and noise flow which flow into and around the at least one motor and into the cooling exhaust pipe and out of the negative pressured plenum chamber, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined also further alternatively in detail, the present invention is an improved power unit for a vacuum cleaner including a canister having a sidewall, a top and a bottom, an upper interior hollow compartment housing a removable dirt and dust collection receptacle, a lower interior hollow compartment which houses at least one motor and armature, and a pipe connecting the upper and lower compartments together, with the at least one motor emitting noise when the at least one motor is turned on, the improvement comprising: (a) bracket means for mounting the at least one motor into the lower interior compartment which forms a negative pressured plenum chamber and spaced apart from a bottom of the negative chamber such that the armature is extending upwardly therefrom; (b) a cooling exhaust pipe in the sidewall to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment through the air intake means and through the pipe and into the negative pressured plenum chamber which in turn is sucked into a motor opening located adjacent to the bottom of the negative chamber, the suction air becomes cooling air and noise flow which flow into and around the at least one motor and into the cooling exhaust pipe and out of the negative chamber, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again further alternatively in detail, the present invention is an improved power unit for a vacuum cleaner including a canister having a sidewall, a top and a bottom, an upper interior hollow compartment housing a removable dirt and dust collection receptacle, and a lower interior hollow compartment which houses at least one motor and armature, with the at least one motor emitting noise when the at least one motor is turned on, the improvement comprising: (a) bracket means for mounting the at least one motor into the lower interior compartment which forms a negative pressured plenum chamber and spaced apart from the sidewall; (b) a cooling exhaust pipe in the sidewall to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment through the air intake means which in turn is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined even further alternatively in detail, the present invention is an improved power unit for a vacuum cleaner including a canister having a sidewall, a top and a bottom, an upper interior hollow compartment housing a removable dirt, a lower interior hollow compartment which houses at least one motor and armature, and a pipe connecting the upper and lower compartments together, with the at least one motor emitting noise when the at least one motor is turned on, the improvement comprising: (a) bracket means for mounting the at least one motor into the lower interior compartment which forms a negative pressured plenum chamber and spaced apart from the sidewall; (b) a cooling exhaust pipe in the sidewall to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment through the air intake means and passes through the pipe and sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined also even further alternatively in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) an air flow baffle plate mounted within the lower interior compartment which forms a negative pressured plenum chamber and spaced apart from the bottom, the baffle plate surrounding the at least one motor and the armature, such that the at least one motor is mounted and spaced apart from a lower side of the baffle plate; (b) a cooling exhaust pipe in the bottom to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment through the air intake means and flows around the baffle plate and is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, a top and a bottom, an upper interior hollow compartment housing a removable dirt and dust collection receptacle, a lower interior hollow compartment which houses at least one motor and armature, and a pipe connecting the upper and lower compartments together, with the at least one motor emitting noise when the at least one motor is turned on, the improvement comprising: (a) an air flow baffle plate mounted within the lower interior compartment which forms a negative pressured plenum chamber and spaced apart from the bottom, the baffle plate surrounding the at least one motor and the armature, such that the at least one motor is mounted and spaced apart from a lower side of the baffle plate; (b) a cooling exhaust pipe in the bottom to permit hot air exhaust and noise flow from the at least one motor to exit the negative pressured plenum chamber, the other end of the cooling exhaust pipe covering the armature; (c) air intake means in the sidewall to permit the suction air to enter the canister; and (d) the suction air flows into the upper compartment through the air intake means and passes through the pipe and flows around the baffle plate and is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising: (a) an air flow baffle plate mounted within the lower interior compartment which forms a negative pressured plenum chamber and spaced apart from the bottom such that the armature is extending downwardly therefrom for permitting suction air to enter thereto, the baffle plate surrounding the at least one motor and the armature, such that the at least one motor is mounted and spaced apart from a lower side of the baffle plate; (b) exhaust means in the bottom to permit hot air exhaust and noise flow from the at least one motor to exit the negative pressured plenum chamber; (c) a motor exhaust horn extending into the negative pressured plenum chamber and connected to the exhaust means; (d) air intake means in the sidewall to permit the suction air to enter the canister; (e) the suction air flows into the upper compartment through the air intake means and flows around the baffle plate and is sucked into a motor opening by the armature, the suction air becomes cooling air and noise flow which flow around and into the at least one motor and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; and (f) a cover having soundproof material located adjacent to the bottom of the canister for receiving the suction air and the noise flow therethrough; (g) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) bracket means for mounting the at least one motor into the second compartment which forms a negative pressured plenum chamber and spaced apart from one of the at least two opposite ends such that the armature is extending away from one of the at least two opposite ends for permitting suction air to enter thereto; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) air intake means in the other one of the at least two opposite ends to permit the suction air to enter the canister; and (e) the suction air flows into the first compartment through the air intake means and sucked by the armature, the suction air becomes cooling air and noise flow which flow around the at least one motor and into a motor opening located adjacent to one of the at least two opposite ends of the negative pressured plenum chamber and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) bracket means for mounting the at least one motor into the second compartment which forms a negative pressured plenum chamber and spaced apart from one of the at least two opposite ends such that the armature is extending away from one of the at least two opposite ends for permitting suction air to enter thereto; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) an air diffuser plate affixed to the sidewall and separating the first and second compartments, the air diffuser having an opening; (e) air intake means in the other one of the at least two opposite ends to permit the suction air to enter the canister; and (f) the suction air flows into the first compartment and sucked by the armature through the opening of the diffuser plate, the suction air becomes cooling air and noise flow which flow around the at least one motor and into a motor opening located adjacent to one of the at least two opposite ends of the negative pressured plenum chamber and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (g) whereby the negative pressured plenum chamber reduces the noise level emitted from the at least one motor while at the same time cooling said at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) an air flow baffle mounted within the second compartment which forms a negative pressured plenum chamber and spaced apart from one of the at least two opposite ends, the baffle surrounding the at least one motor and the armature, such that the at least one motor is mounted and spaced apart from a lower side of the baffle plate and the armature extending toward one of the at least two opposite ends for permitting suction air to enter thereto; (b) exhaust means in the sidewall to permit hot air exhaust and noise flow from the at least one motor to exit the negative pressured plenum chamber, (c) a motor exhaust horn extending into the negative pressured plenum chamber and connected to the exhaust means; (d) air intake means in the other one of the at least two opposite ends to permit the suction air to enter the canister; and (e) the suction air flows into the first compartment through the air intake means which in turn flows around the air flow baffle and sucked by the armature, the suction air becomes cooling air and noise flow which flow around the at least one motor and into a motor opening located adjacent to the lower side of the baffle and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum compartment reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, a second hollow compartment which houses at least one motor and armature, and a pipe connecting the first and second compartments together, with the at least one motor emitting noise when the at least one motor is turned on, the improvement comprising: (a) an air flow baffle mounted within the second compartment which forms a negative pressured plenum chamber and spaced apart from one of the at least two opposite ends, the baffle surrounding the at least one motor and the armature, such that the at least one motor is mounted and spaced apart from a lower side of the baffle and the armature extending toward one of the at least two opposite ends for permitting suction air to enter thereto; (b) exhaust means in the sidewall to permit hot air exhaust and noise flow from the at least one motor to exit the negative pressured plenum chamber; (c) a motor exhaust horn extending into the negative pressured plenum chamber and connected to the exhaust means; (d) air intake means in the other one of the at least two opposite ends to permit the suction air to enter the canister, and (e) the suction air flows into the first compartment which in turn flows through the pipe and around the baffle and sucked by the armature, the suction air becomes cooling air and noise flow which flow around the at least one motor and into a motor opening located adjacent to the lower side of the baffle and into the motor exhaust horn and out through the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (f) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) bracket means for mounting the at least one motor into the second compartment which forms a negative pressured plenum chamber and spaced apart from one of the at least two opposite ends such that the armature is extending away from one of the at least two opposite ends; (b) a cooling exhaust pipe in the sidewall to permit hot air exhaust and noise flow from the at least one motor to exit the negative pressured plenum chamber, the other end of the cooling exhaust pipe covering the armature; (c) air intake means in the other one of the at least two opposite ends to permit the suction air to enter the canister; and (d) the suction air flows into the first compartment through the air intake means which in turn is sucked into a motor opening located adjacent to one of the at least two opposite ends, the suction air becomes cooling air and noise flow which flow into and around the at least one motor and into the cooling exhaust pipe and out of the negative chamber, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, a second hollow compartment which houses at least one motor and armature, and a pipe connecting the first and second compartments, with the at least one motor emitting noise when the at least one motor is turned on, the improvement comprising: (a) bracket means for mounting the at least one motor into the second compartment which forms a negative pressured plenum chamber and spaced apart from one of the at least two opposite ends such that the armature is extending away therefrom; (b) a cooling exhaust pipe in the sidewall to permit hot air exhaust and noise flow from the at least one motor to exit the negative pressured plenum chamber, the other end of the cooling exhaust pipe covering the armature; (c) air intake means in the other one of the at least two opposite ends to permit the suction air to enter the canister; and (d) the suction air flows into the first compartment through the air intake means and passes through the pipe and into the negative pressured plenum chamber which in turn is sucked into a motor opening located adjacent to the bottom, the suction air becomes cooling air and noise flow which flow into and around the at least one motor and into the cooling exhaust pipe and out of the negative chamber, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) bracket means for mounting the at least one motor into the second compartment which forms a negative pressured plenum chamber and spaced apart from the sidewall; (b) a cooling exhaust pipe in the sidewall to permit hot air exhaust and noise flow from the at least one motor to exit the negative pressured plenum chamber, the other end of the cooling exhaust pipe covering the armature; (c) air intake means in one of the at least two opposite ends to permit the suction air to enter the canister; and (d) the suction air flows into the first compartment through the air intake means which in turn is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor, (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, a second hollow compartment which houses at least one motor and armature, and a pipe connecting the upper and lower compartments together, with the at least one motor emitting noise when the at least one motor is turned on, the improvement comprising: (a) bracket means for mounting the at least one motor into the second compartment which forms a negative pressured plenum chamber and spaced apart.from the sidewall; (b) a cooling exhaust pipe in the sidewall to permit hot air exhaust and noise flow from the at least one motor to exit the negative pressured plenum chamber, the other end of the cooling exhaust pipe covering the armature; (c) air intake means in one of the at least two opposite ends to permit the suction air to enter the canister; and (d) the suction air flows into the first compartment through the air intake means which in turn flows through the pipe and sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, and a second hollow compartment which houses at least one motor and armature, with the at least one motor emitting noise when the at least one motor is turned on, the improvement comprising: (a) an air flow baffle mounted within the second compartment which forms a negative pressured plenum chamber and spaced apart from one of the at least two opposite ends, the baffle surrounding the at least one motor and the armature, where the at least one motor is mounted and spaced apart from a lower side of the baffle; (b) a cooling exhaust pipe in the bottom to permit hot air exhaust and noise flow from the at least one motor to exit the negative pressured plenum chamber, the other end of the cooling exhaust pipe covering the armature; (c) air intake means in the other one of the at least two opposite ends to permit the suction air to enter the canister; and (d) the suction air flows into the first compartment through the air intake means which in turn flows around the baffle and is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Defined again even further alternatively in detail, the present invention is an improved power unit for a vacuum cleaner including a canister having a sidewall, at least two opposite ends, a first hollow compartment housing a removable dirt and dust collection receptacle, a second hollow compartment which houses at least one motor and armature, and a pipe connecting the first and second compartments together, with the at least one motor emitting noise when the at least one motor is turned on, the improvement comprising: (a) a plate mounted within the second compartment which forms a negative pressured plenum and spaced apart from one of the at least two opposite ends, the plate surrounding the at least one motor and the armature, where the at least one motor is mounted and spaced apart from a lower side of the plate; (b) a cooling exhaust pipe in one of the at least two opposite ends to permit hot air exhaust and noise flow from the at least one motor to exit the negative pressured plenum chamber, the other end of the cooling exhaust pipe covering the armature; (c) air intake means in the other one of the at least two opposite ends to permit the suction air to enter the canister; and (d) the suction air flows into the first compartment through the air intake means and passes through the pipe and around the plate and is sucked into a motor opening by the armature, the suction air becomes cooling air and noise flow which flow around and into the at least one motor and out through the cooling exhaust pipe, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Further defined more broadly, the present invention is an improved power unit for a vacuum cleaner including a canister having a sidewall, at least two opposite ends, a first compartment housing a removable dirt and dust collection receptacle, and a second compartment which houses at least one motor and armature, with the at least one motor emitting noise when the at least one motor is turned on, the improvement comprising: (a) means for mounting the at least one motor into the second compartment which forms a negative pressured plenum chamber, the at least one motor spaced apart from a surface of the negative pressured plenum chamber, (b) exhaust means in the negative pressured plenum chamber to permit hot air exhaust and noise flow from the at least one motor to exit the negative pressured plenum chamber; (c) air intake means in the first compartment to permit the suction air to enter the canister; and (d) the suction air flows into the first compartment through the air intake means which in turn flows into the negative pressured plenum chamber, where the suction air becomes cooling air and noise flow which flow around the at least one motor and into a motor opening by the armature and out the exhaust means, thereby substantially reducing the noise level generated by the at least one motor while at the same time cooling the at least one motor, the noise that radiates from the at least one motor continually sucked back into the at least one motor, and thereby the noise is bent by using suction so that the noise is muffled by being pulled back into the at least one motor; (e) whereby the negative pressured plenum chamber reduces the noise level emitted from the at least one motor while at the same time cooling the at least one motor.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. An improved power unit for a vacuum cleaner including a canister having a sidewall, a top and a bottom, an upper interior hollow compartment housing a removable dirt and dust collection receptacle and a lower interior hollow compartment which houses at least one motor and armature, with the at least one motor emitting noise when the at least one motor is turned on, the improvement comprising:

a. bracket means mounting said at least one motor into said lower interior compartment which forms a negative pressured plenum chamber, where said at least one motor is spaced apart from said bottom such that said armature is extending upwardly therefrom for permitting suction air to enter thereto;

b. exhaust means in said sidewall to permit hot air exhaust and noise flow from said at least one motor to exit said negative pressured plenum chamber;

c. a motor exhaust horn extending into said negative pressured plenum chamber and connected to said exhaust means;

d. air intake means in said sidewall to permit said suction air to enter said canister; and e. said suction air flows into said upper compartment and into said negative pressured plenum chamber, where said suction air becomes cooling air and noise flow which in turn flow around said at least one motor and into a motor opening located adjacent to said bottom of said canister and into said motor exhaust horn and out through said exhaust means, thereby substantially reducing the noise level generated by said at least one motor while at the same time cooling said at least one motor, the noise that radiates from said at least one motor continually sucked back into said at least one motor, and thereby the noise is bent by using suction so that the noise is muffled by being pulled back into said at least one motor;

f. whereby said negative pressured plenum chamber reduces the noise level emitted from said at least one motor while at the same time cooling said at least one motor.

2. The improvement of the improved power unit in accordance with claim, 1, wherein said exhaust means includes at least one exhaust port located in said sidewall and extending into said negative pressured plenum chamber.

3. The improvement of the improved power unit in accordance with claim 1, wherein said air intake means includes at least one intake port located in said sidewall and extending into said upper interior compartment.

4. The improvement of the improved power unit in accordance with claim 1, wherein said exhaust means comes out of said motor and extends through said negative pressure plenum chamber and extends out of said sidewall.

5. An improved power unit for a vacuum cleaner including a canister having a sidewall, at least two opposite ends, a first compartment housing a removable dirt and dust collection receptacle, and a second compartment which houses at least one motor and armature, with the at least one motor emitting noise when the at least one motor is turned on, the improvement comprising:

a. means for mounting said at least one motor into said second compartment which forms a negative pressured suction plenum chamber, said at least one motor spaced apart from a surface of the negative pressured suction plenum chamber;

b. exhaust means in said negative pressured suction plenum chamber to permit hot air exhaust and noise flow from said at least one motor to exit said negative pressured suction plenum chamber;

c. air intake means in said first compartment to permit said suction air to enter said canister; and d. means to cause said suction air to flow into said first compartment through said air intake means which in turn is caused to flow into said negative pressured suction plenum chamber, where said suction air becomes cooling air and noise flow which flows around said at least one motor and into a motor opening by said armature and out said exhaust means, thereby substantially reducing the noise level generated by said at least one motor while at the same time cooling said at least one motor, the noise that radiates from said at least one motor continually sucked back into said at least one motor, and thereby the noise is bent by using suction so that the noise is muffled by being pulled back into said at least one motor;

e. whereby said negative pressured plenum chamber reduces the noise level emitted from said at least one motor while at the same time cooling said at least one motor.

6. The improvement of the improved power unit in accordance with claim 5, wherein said exhaust means includes at least one exhaust port.

7. The improvement of the improved power unit in accordance with claim 5, wherein said air intake means includes at least one intake port.

8. The improvement of the improved power unit in accordance with claim 5, further comprising a motor exhaust horn extending into said negative pressured suction plenum chamber and connected to said exhaust means.

9. The improvement of the improved power unit in accordance with claim 5, wherein said vacuum cleaner includes a central vacuum cleaning system.

10. The improvement of the improved power unit in accordance with claim 5, wherein said vacuum cleaner includes a portable vacuum cleaner.

11. An improved power unit for a vacuum cleaner including a canister having a sidewall, at least two opposite ends, a first compartment housing a removable dirt and dust collection receptacle, and a second compartment which houses at least one motor and armature, with the at least one motor emitting noise when the at least one motor is turned on, the improvement comprising:

a. means for mounting said at least one motor into said second compartment which forms a negative pressured plenum chamber, said at least one motor spaced apart from a surface of the negative pressured plenum chamber;

b. exhaust means in said negative pressured plenum chamber to permit hot air exhaust and noise flow from said at least one motor to exit said negative pressured plenum chamber;

c. air intake means in said first compartment to permit said suction air to enter said canister;

d. said suction air flows into said first compartment through said air intake means which in turn flows into said negative pressured plenum chamber, where said suction air becomes cooling air and noise flow which flow around said at least one motor and into a motor opening by said armature and out said exhaust means, thereby substantially reducing the noise level generated by said at least one motor while at the same time cooling said at least one motor, the noise that radiates from said at least one motor continually sucked back into said at least one motor, and thereby the noise is bent by using suction so that the noise is muffled by being pulled back into said at least one motor; and e. a motor exhaust horn extending into said negative pressured plenum chamber and connected to said exhaust means;

f. whereby said negative pressured plenum chamber reduces the noise level emitted from said at least one motor while at the same time cooling said at least one motor.

12. The improvement of the improved power unit in accordance with claim 11, wherein said exhaust means includes at least one exhaust port.

13. The improvement of the improved power unit in accordance with claim 11, wherein said air intake means includes at least one intake port.

14. The improvement of the improved power unit in accordance with claim 11, wherein said vacuum cleaner includes a central vacuum cleaning system.

15. The improvement of the improved power unit in accordance with claim 11, wherein said vacuum cleaner includes a portable vacuum cleaner.

* * * * *